United States Patent [19]

Losee

[11] Patent Number: 4,809,010

[45] Date of Patent: Feb. 28, 1989

[54] LOW PROFILE WIRELESS COMMUNICATION SYSTEM AND METHOD

[75] Inventor: Ferril A. Losee, Provo, Utah

[73] Assignee: Canon Kabushiki Kaisha, Tokyo, Japan

[21] Appl. No.: 393,044

[22] Filed: Jun. 23, 1982

Related U.S. Application Data

[63] Continuation-in-part of Ser. No. 308,080, Oct. 2, 1981.

[51] Int. Cl.[4] ..... H01Q 1/04

[52] U.S. Cl. ..... 343/719; 343/847; 343/877

[58] Field of Search ..... 343/719, 724, 794, 813, 343/847, 877, 754

[56] References Cited

U.S. PATENT DOCUMENTS

| | | | |
|---|---|---|---|
| 714,246 | 11/1902 | Shoemaker . | |
| 760,463 | 5/1904 | Marconi . | |
| 771,818 | 10/1904 | DeForest . | |
| 795,762 | 7/1905 | Garcia . | |
| 1,101,533 | 6/1914 | De Forest . | |
| 1,123,119 | 12/1914 | DeForest . | |
| 1,220,005 | 3/1917 | Rogers et al. . | |
| 1,303,729 | 5/1919 | Rogers . | |
| 1,303,730 | 5/1919 | Rogers . | |
| 1,315,862 | 9/1919 | Rogers . | |
| 1,316,188 | 9/1919 | Rogers . | |
| 1,322,622 | 11/1919 | Rogers et al. . | |
| 1,349,103 | 8/1920 | Rogers . | |
| 1,349,104 | 8/1920 | Rogers | 343/719 |
| 1,373,612 | 4/1921 | Hanson . | |
| 1,377,129 | 5/1921 | Hahnemann . | |
| 1,387,736 | 8/1921 | Rogers . | |
| 1,395,454 | 11/1921 | Rogers . | |
| 1,424,365 | 8/1922 | Loftin et al. . | |
| 1,429,240 | 9/1922 | Hanson et al. . | |
| 1,510,799 | 10/1924 | Rogers . | |
| 1,530,129 | 3/1925 | Loftin et al. . | |
| 1,894,244 | 1/1933 | Ruble . | |
| 2,161,044 | 6/1939 | Heintz et al. | 173/367 |
| 2,225,668 | 12/1940 | Subkow et al. | 177/352 |
| 2,574,733 | 11/1951 | Ehrlich | 250/33 |
| 2,712,602 | 7/1955 | Hallen | 343/793 |
| 2,834,012 | 5/1958 | Allen | 343/723 |
| 2,842,768 | 7/1958 | Halperin | 343/877 |
| 2,989,621 | 6/1961 | Barton et al. | 250/4 |
| 2,992,325 | 7/1961 | Lehan | 250/3 |
| 2,998,516 | 8/1961 | Lehan et al. | 250/5 |
| 3,183,510 | 5/1965 | Rawls | 343/719 |
| 3,212,093 | 10/1965 | Brueckmann | 343/724 |

(List continued on next page.)

FOREIGN PATENT DOCUMENTS

| | | | |
|---|---|---|---|
| 676331 | 12/1963 | Canada | 250/33.53 |

OTHER PUBLICATIONS

Secor, H. W., "America's Greatest War Invention: The Rogers Underground Wireless," Electrical Experimenter (Mar., 1919), pp. 53–60.

(List continued on next page.)

*Primary Examiner*—Theodore M. Blum

*Attorney, Agent, or Firm*—Fitzpatrick, Cella, Harper & Scinto

[57] ABSTRACT

A transportable wireless communication system and method for employing lightweight, compact, low profile surface deployed current drivers which are capable of rapid deployment and quick retrieval and which are used for inducing ground currents in the earth so as to send and receive electromagnetic signals propagated through the atmosphere over a wide bandwidth. The impedance of the current driver and earth is adjusted to match the impedance of a transmitter/receiver connected thereto. The current driver is capacitively coupled to the earth so that the current driver and the earth effectively function together as a vertical plane polarized antenna which propagates a vertically polarized electromagnetic signal. The system utilizes either a single current driver or, where increased signal gain is desired, an array of current drivers spaced in parallel. A unidirectional vertically polarized signal may be produced by shortening the length of one current driver conducting arm with respect to the other arm. Unwanted cancellation currents may be substantially eliminated from the region surrounding the current driver by elevating portions of the current drivr or by positioning low conductivity materials so as to extend into the flow paths of the cancellation currents.

76 Claims, 10 Drawing Sheets

(S)

U.S. PATENT DOCUMENTS

| | | | |
|---|---|---|---|
| 3,215,937 | 11/1965 | Tanner | 325/28 |
| 3,346,864 | 10/1967 | Harmon | 343/719 |
| 3,400,402 | 9/1968 | Gallagher et al. | 343/877 |
| 3,435,457 | 3/1969 | Brueckmann | 343/719 |
| 3,577,148 | 5/1971 | Holzschuh et al. | 343/877 |
| 3,594,798 | 7/1971 | Leydorf et al. | 343/719 |
| 3,705,407 | 12/1972 | Wichersham | 343/719 |
| 3,775,772 | 11/1973 | Carrell | 343/719 |
| 3,803,616 | 4/1974 | Kopf et al. | 343/719 |
| 3,867,710 | 2/1975 | Busignies | 340/4 |
| 3,967,201 | 6/1976 | Rorden | 179/82 |
| 4,511,898 | 4/1985 | Bush | 343/736 |
| 4,687,445 | 8/1987 | Williams | 343/719 |

OTHER PUBLICATIONS

Rogers, J. H., "The Rogers Underground Aerial for Amateurs," Electrical Experimenter (Jun. 1919), pp. 76–78.

Lavrov, G. A. et al., *Prizemnyye i Podzemnyye Antenny* [Near Earth and Buried Antennas], Chapter V, pp. 256–297 (1965, U.S.S.R.).

G. A. Lavrov et al., Prizemnyye i Podzemnyye Antenny [Near Earth and Buried Antennas], Chapter V, pp. 256–297 (1965, U.S.S.R).

King, Ronald W. P., "The Theory of Linear Antennas with Charts and Tables for Practical Applications," pp. 436, 579–597 (1956).

"Antenna Engineering Handbook," edited by Henry Jasik, pp. 215–224 (1961).

Guy, A. W. & Hasserjian, G., "Underground Antenna Systems Design Handbook," The Boeing Company Report No. D2–7760 (Nov. 1961) also known as Design Criteria for Buried Antennas (produced under Minuteman Contract No. AF 04(647)–289).

Hasserjian, G. & Guy, A. W., "Low-Frequency Subsurface Antennas," IEEE Transactions on Antennas and Propagation, pp. 225–232 (May 1963).

Guy, A. W., & Hasserjian, G., "Impedance Properties of Large Subsurface Antenna Arrays," IEEE Transactions on Antennas and Propagation, pp. 232–240 (May 1963).

Wundt, R., "Buried Traveling-Wave Antennas," Applied Research Laboratory, Sylvania Electronic Systems, Research Report No. 394 (Mar. 1964).

Wolff, Edward A., "Antenna Analysis," pp. 241–267 (1966).

Blake, LaMont V., "Antennas," pp. 209–255 (1966).

"The Radio Amateur's Handbook," American Radio Relay League, 1973, 50th Ed., pp. 578–581.

Christinsin, Alan S., "More on the Long Haul Inverted L Long Wire")(1976).

Christinsin, Alan S., "The AFWONXX Longwire," (1976).

Christinsin, Alan S., "More on the AFWONXX Sloping Long Wire," (1976).

Christinsin, Alan S., "Theoretical Performance Comparison of Two Tactical Long Wire Type Antennas Over Poor Ground," (1976).

Misek, Victor A., "The Beverage Antenna Handbook," First Edition (1977).

"Antenna Engineering Handbook, Second Edition," edited by Richard C. Johnson and Henry Jasik, pp. 11–18 (1961–1984).

Drumeller, Carl C., "Travelling-Wave Antennas," CQ Magazine, p. 32 (Apr. 1984).

Smith, Glenn S., "Annotated Bibliography on Buried Antennas," Georgia Institute of Technology, School of Electrical Engineering, (Feb. 1986) (produced under Government Contract No. F30602–81–C–0185).

"Notes, Wireless Telegraphy with Invisible Antennae," *The Electrician,* No. 1,764 at 1 (Mar. 8, 1912, Great Britain).

Kiebitz, F., "Recent Experiments on Directive Wireless Telegraphy with Earth Antennae," *The Electrician,* No. 1,764, at 868–70 (Mar. 8, 1912, Great Britain).

The American Radial Relay League, Inc., The A.R.R.L. Antenna Book, pp. 236–237 (1960).

Blair, W. E., "Experimental Verification of Dipole Radiation in a Conducting Half-Space," *IEEE Transactions on Antennas and Propagation,* at 269–275, May, 1963).

Chen, C. L. and King, R. W. P., "The Small Bare Loop Antenna Immersed in a Dissipative Medium," *IEEE Transactions on Antennas and Propagation,* at 266–269 (May, 1963).

Hansen, R. C., "Radiation and Reception with Buried and Submerged Antennas," *IEEE Transactions on Antennas and Propagation,* at 207–216 (May, 1963).

King, R. W. P. and Iizuka, K., "The Complete Electromagnetic Field of a Half-Wave Dipole in a Dissipative Medium," *IEEE Transactions on Antennas and Propagation,* at 275–285 (May, 1963).

Iizuka, K., "The Circular Loop Antenna Immersed in a Dissipative Medium," *IEEE Transactions on Antennas and Propagation,* 43–47 (Jan., 1965).

OTHER PUBLICATIONS

Galejs, J., 15 *Antennas in Inhomogeneous Media* (1969), p. 71 of Chapter 6; & 9.1 of Chapter 9; & 10.3 of Chapter 10.

Biggs, A. W. and Swarm, H. M., "Radiation Fields of an Inclined Electric Dipole Immersed in a Semi-Infinite Conducting Medium," *IEEE Transactions on Antennas and Propagation,* at 306-310 (May, 1973).

Fenwick, R. C. and Weeks, W. L., "Submerged Antenna Characteristics," *IEEE Transactions on Antennas and Propagation,* at 296-305 (May, 1973).

Lee, K. M. and Smith, G. S., "Measured Properties of Bare and Insulated Antennas in Sand," *IEEE Transactions on Antennas and Propagation,* at 664-667, Sep., 1975).

Shren, L. C., King, R. W. P. and Sorbello, R. M., "Measured Field of a Directional Antenna Submerged in a Lake," *IEEE Transactions on Antennas and Propagation,* at 891-894 (Nov., 1976).

King, R. W. P. and Sandler, B., "Subsurface Communication Between Dipoles in General Media," *IEEE Transactions on Antennas and Propagation,* at 770-775 (Nov., 1977).

Ancona, C., "On Small Antenna Impedance in Weakly Dissipative Media," *IEEE Transactions on Antennas and Propagation,* at 341-343 (Mar., 1978).

Burrell, G. A. and Peters, L. Jr., "Pulse Propagation in Lossy Media Using the Low-Frequency Window for Video Pulse Radar Application," *Proceedings of the IEEE,* at 981-990 (Jul., 1979).

King, R. W. P., Sandler, B. H. and Shen, L. C., "A Comprehensive Study of Subsurface Propagation from Horizontal Electric Dipoles," *IEEE Transactions on Geoscience and Remote Sensing,* at 225-233 (Jul., 1980).

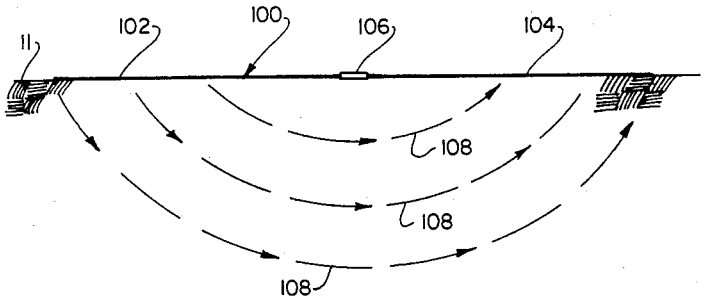
(U) Fig. 1
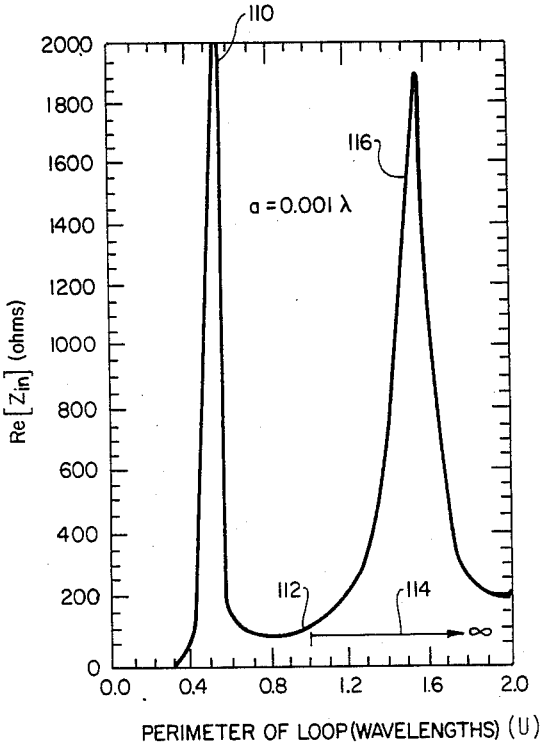
(U) Fig. 2
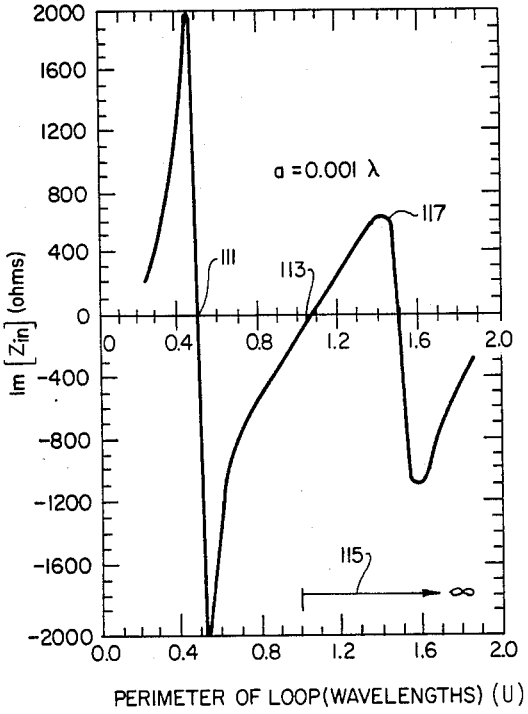
(U) Fig. 3

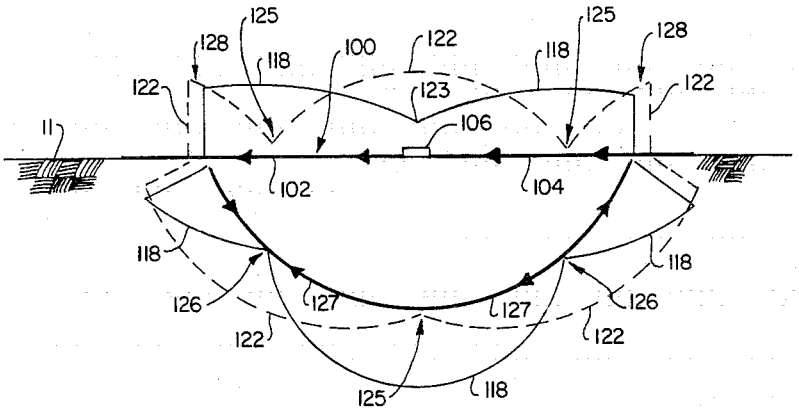
(S) Fig. 4
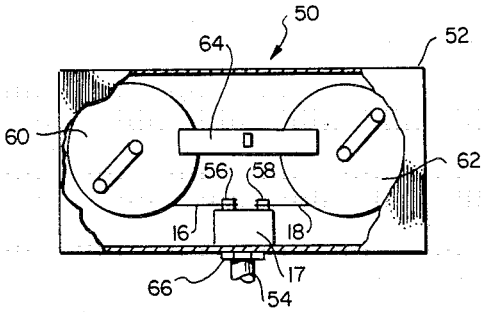
(S) Fig. 5
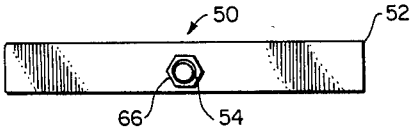
(S) Fig. 6
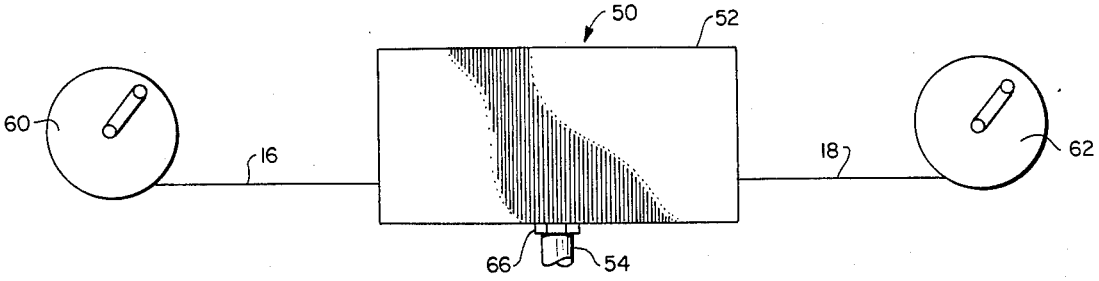
(S) Fig. 7

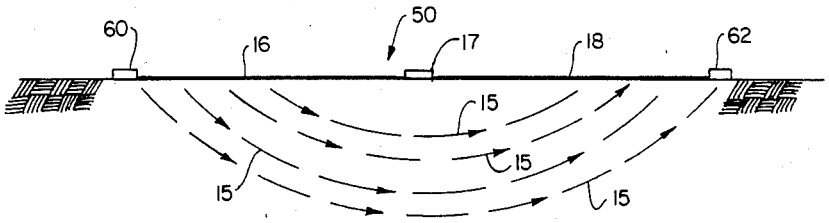
(S) Fig. 8
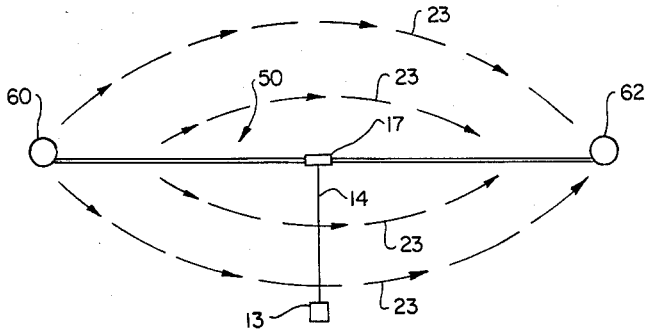
(S) Fig. 9
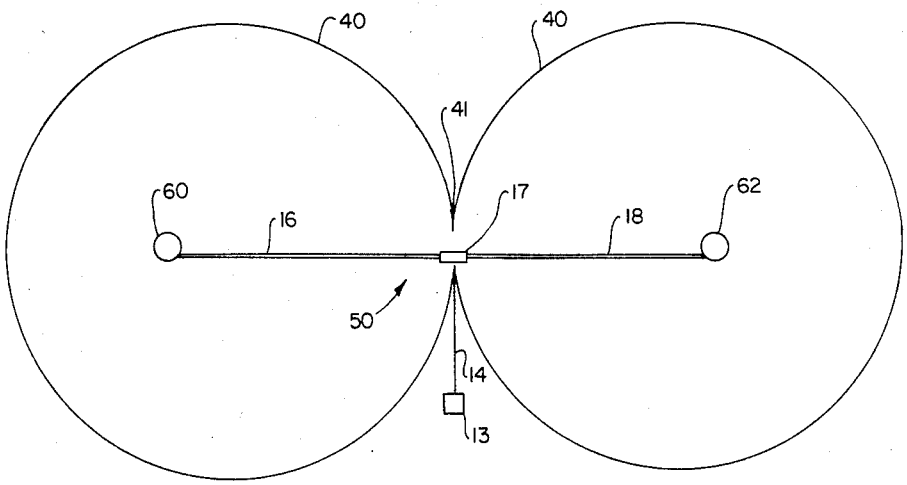
(S) Fig. 10

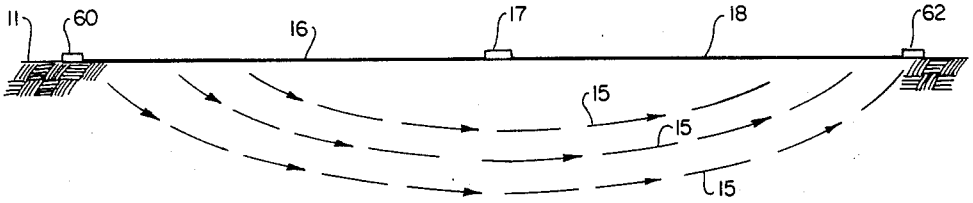
(S) Fig. 11
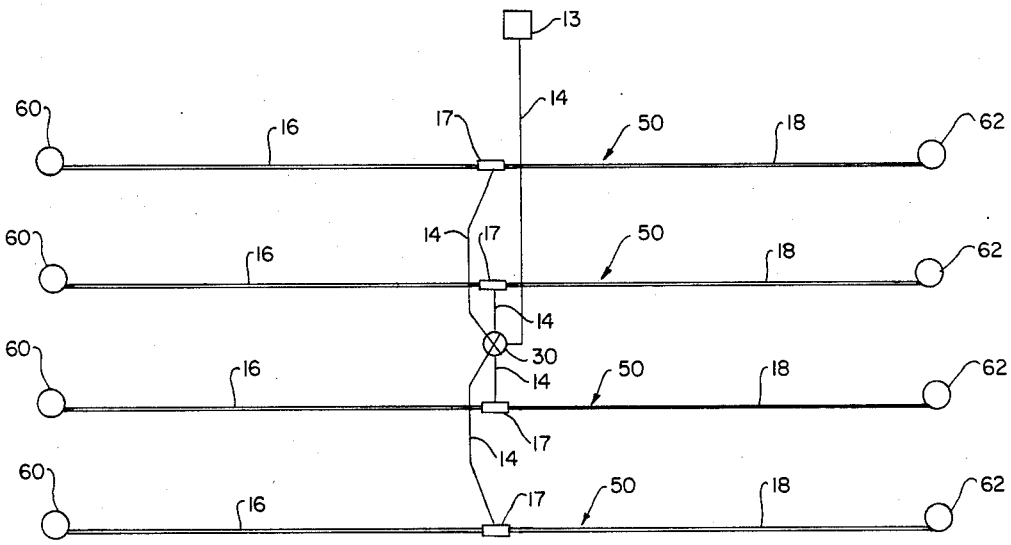
(S) Fig. 12
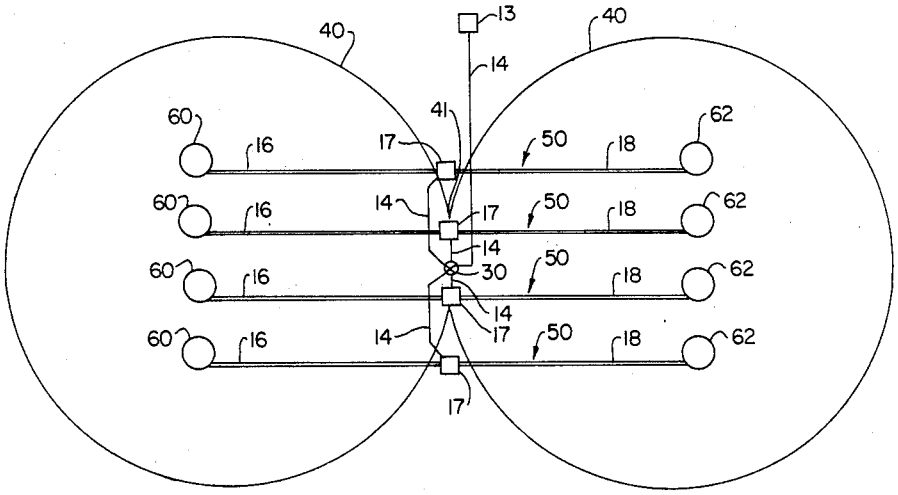
(S) Fig. 13

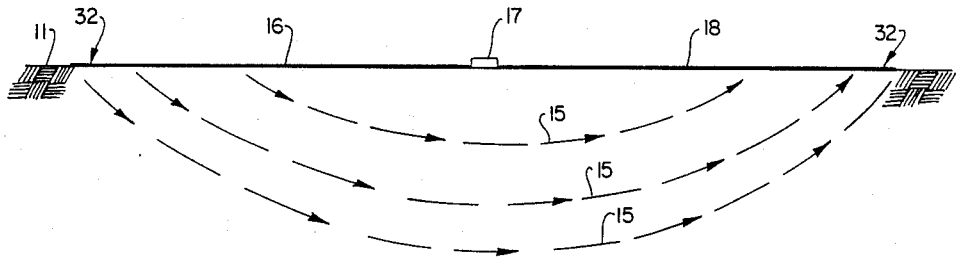
(S) Fig. 14
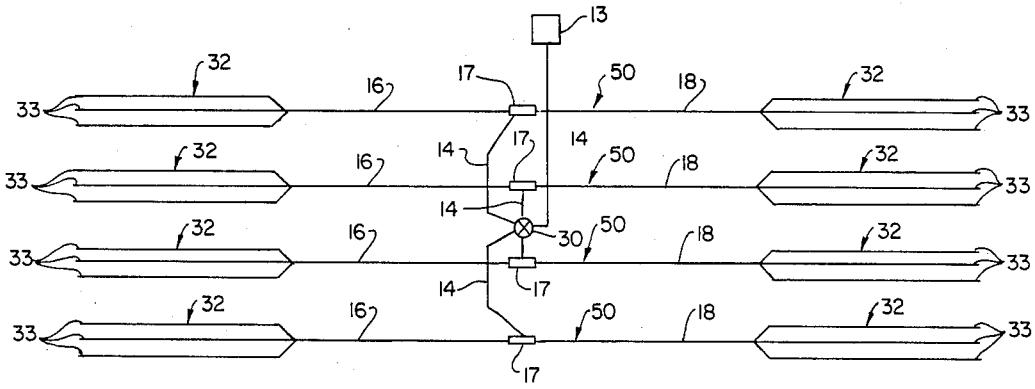
(S) Fig. 15
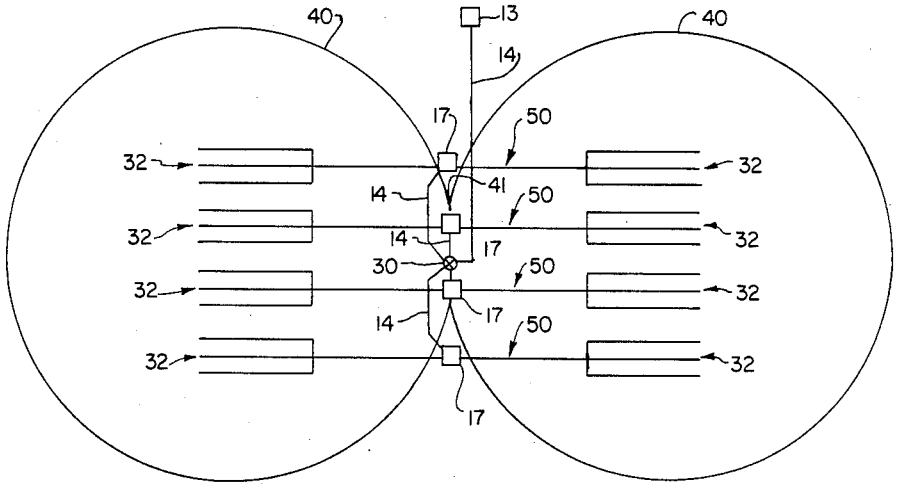
(S) Fig. 16

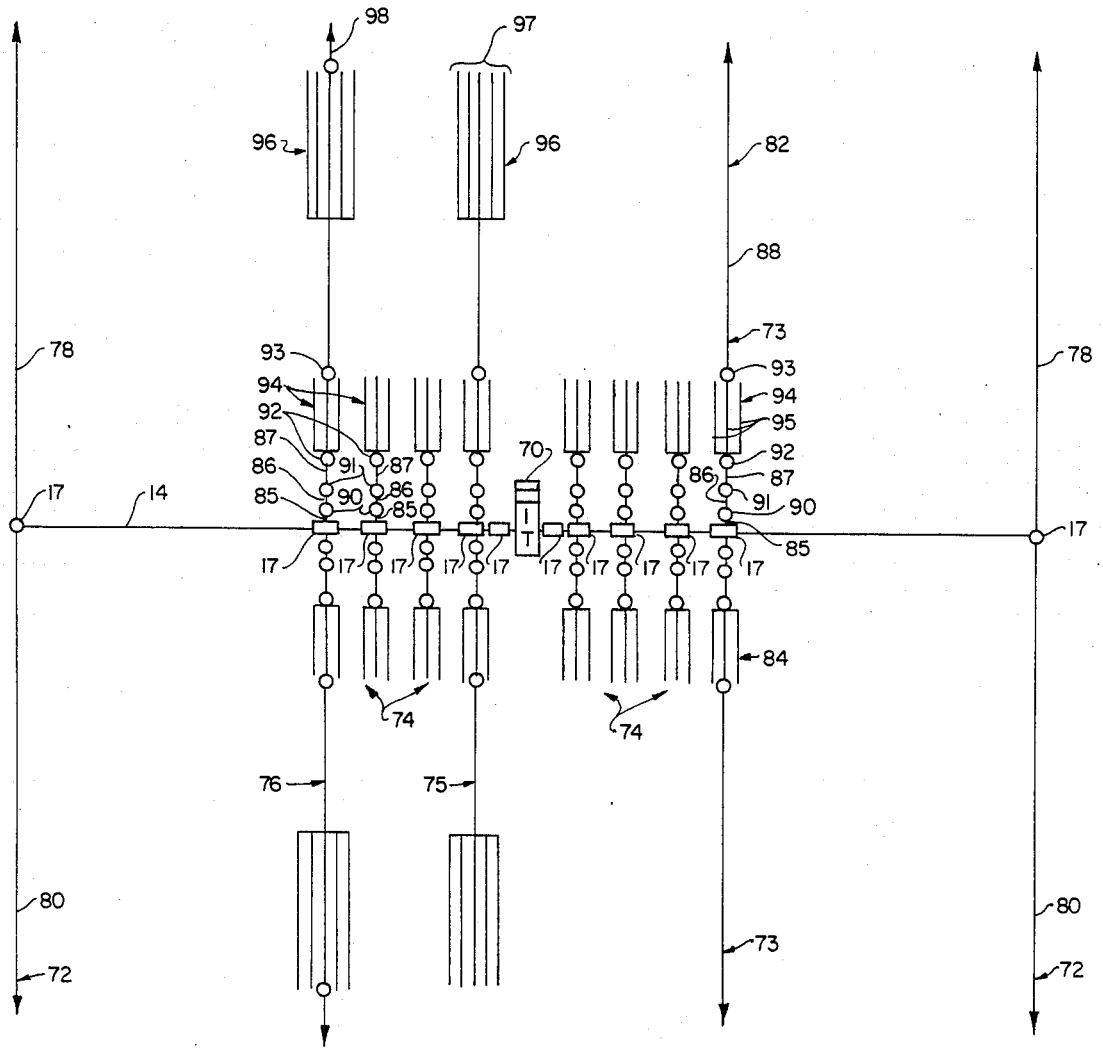
(S) Fig. 17

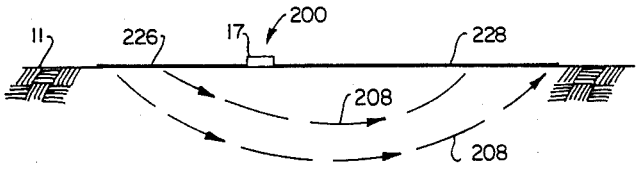
(S) Fig. 18
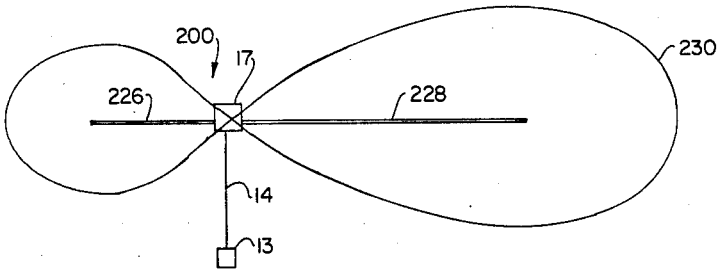
(S) Fig. 19
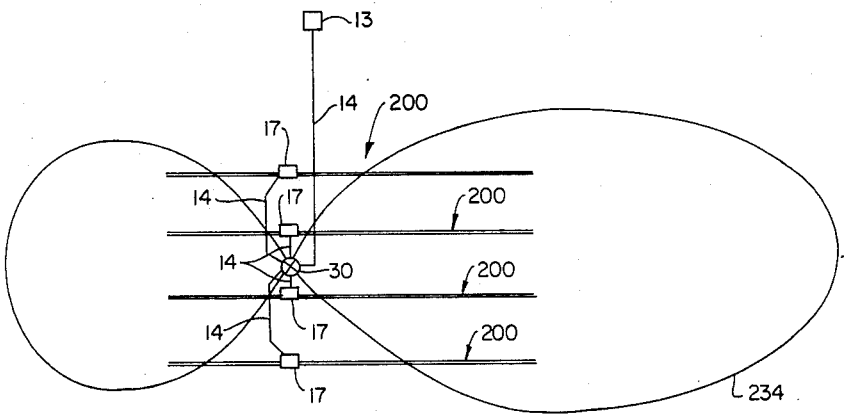
(S) Fig. 20

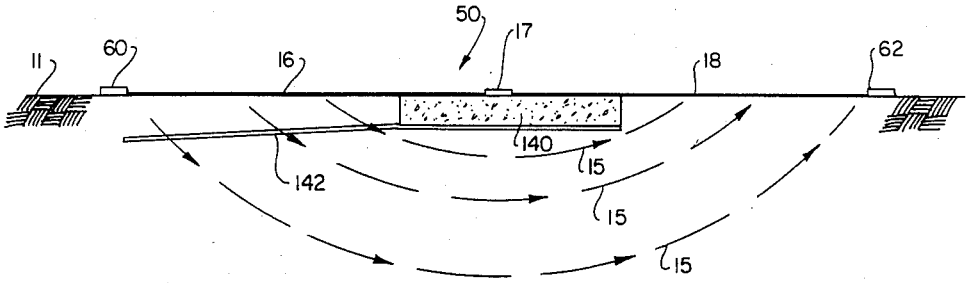
(S) Fig. 21
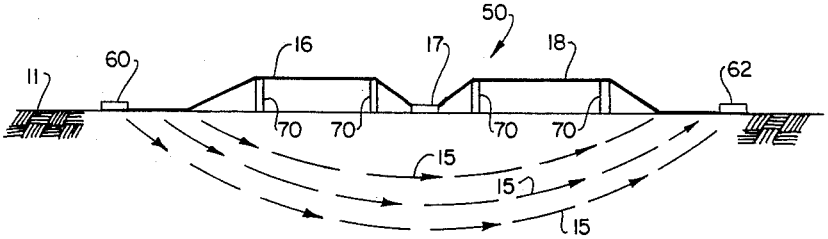
(S) Fig. 22
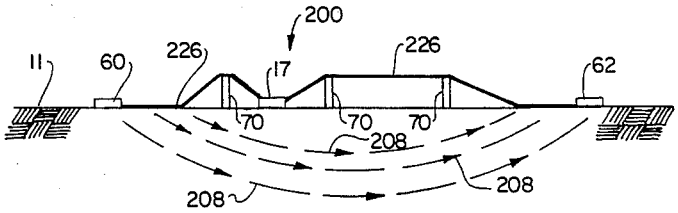
(S) Fig. 23
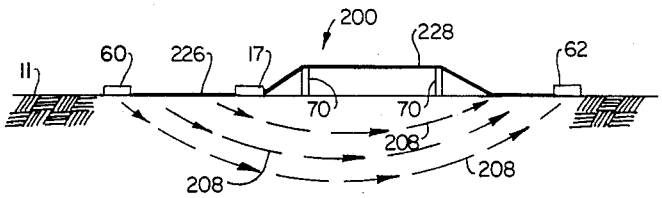
(S) Fig. 24

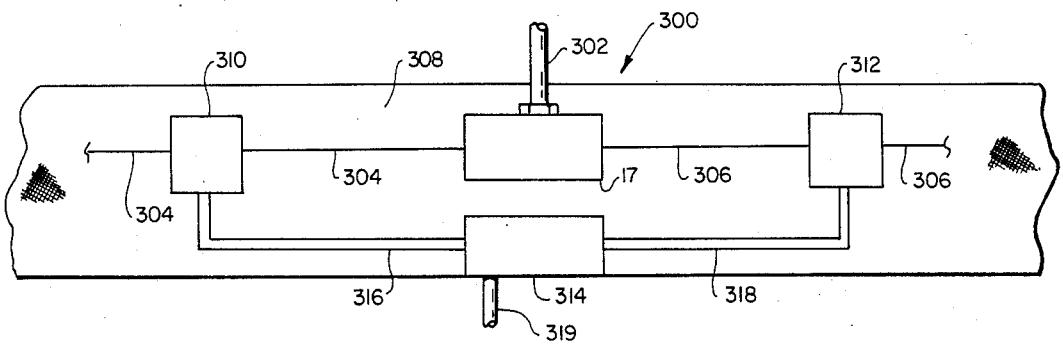
(S) Fig. 25
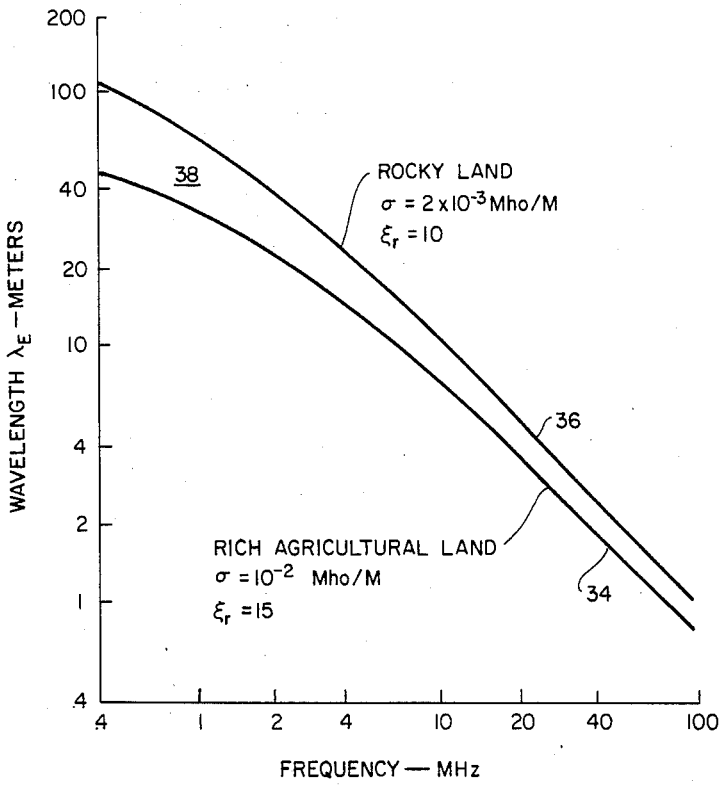
(U) Fig. 26

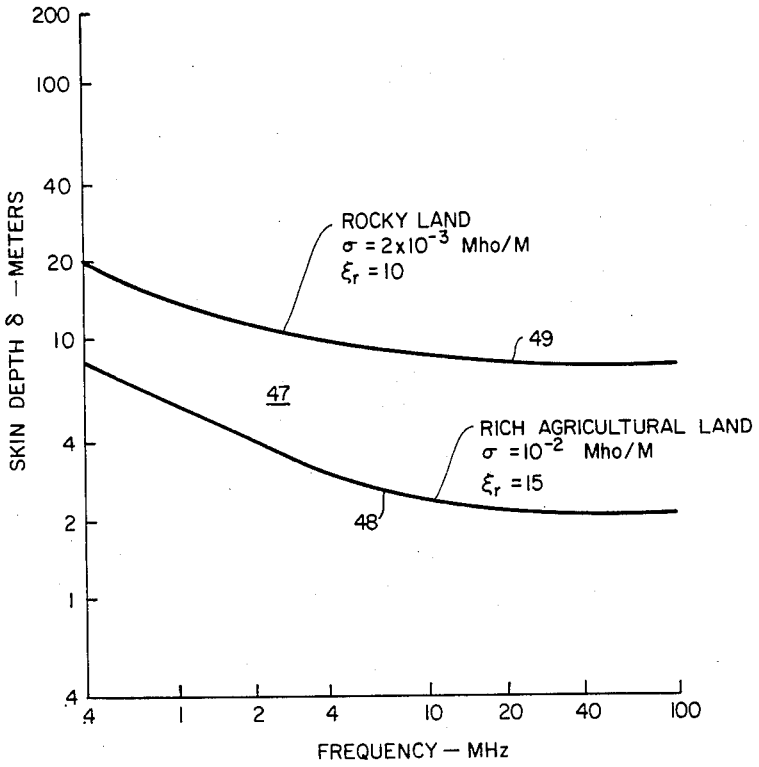
(U) Fig. 27

LOW PROFILE WIRELESS COMMUNICATION SYSTEM AND METHOD

BACKGROUND

1. Related Application

This application is a continuation-in-part of my copending U.S. application Ser. No. 308,080, filed Oct. 2, 1981.

2. Field of the Invention

This invention relates to an improved wireless communication system and method, and more particularly to a system and method for employing low profile deployed current drivers for guiding means and inducing ground currents in the earth in such a way that the current drivers and earth function together as vertical plane polarized antennas which perform as loop or long-wire guided wave antennas and which send and receive vertically polarized electromagnetic signals propagated through the atmosphere over a wide bandwidth.

3. The Prior Art

Aboveground wireless communication systems have been known and used for many years. Generally, such systems employ aboveground antennas which extend high into the air for transmitting and receiving low, medium and high frequency electromagnetic signals which travel through the atmosphere. In a military sense, such aboveground communication systems are considered "soft" for security purposes because they are relatively easy to destroy. "Hardness" (or "softness") is a military term used to denote the system's vulnerability to destruction under attack. The harder a system is, the less vulnerable to destruction it is.

The hardness of a communication system is generally measured by such criteria as its ability to withstand substantial shock, as in the case of a powerful explosion occurring very near to the system and its ability to survive high energy electromagnetic pulse radiation which may be produced by a nuclear blast.

Even though a powerful explosion may be centered some distance from an aboveground communication system, the resulting shock waves will likely damage or destroy the system antennas. Furthermore, aboveground antennas which transmit or receive low, medium or high frequency signals are very susceptible to the adverse effects of electromagnetic pulse radiation. Even though attempts have been made to increase the hardness of aboveground communication systems by constructing backup systems, factors such as cost and environmental considerations make it very difficult to justify and obtain the redundancy required to make such systems secure in the event of attack.

In order to increase system hardness, it is desirable to deploy communication system antennas under the ground or in a low profile configuration upon or above but in close proximity to the ground. These low profile antennas are able to withstand the effects of nearby explosions to a much greater degree than conventional aboveground antennas. Further, such low profile antennas are exposed to less electromagnetic pulse radiation. Because of these advantages, a communication system utilizing underground or low profile antennas requires less redundancy to achieve system security than a comparable communication system using typical aboveground antennas. However, although system hardness is improved, prior art underground and low profile antenna systems have been substantially less efficient in their operation than the high, aboveground antennas. Because of their poor performance characteristics, such antenna systems have had limited and very specific applications and have been wholly unable to adequately function as a replacement for the high, aboveground antenna systems.

Such inadequate performance characteristics are embodied in the various wireless subterranean signaling systems which have been proposed in the past, wherein electromagnetic signals are transmitted through the earth between underground antennas. For example, electromagnetic waves of relatively low frequencies ranging from 100 Hz to 100 KHz have been propagated through the earth between horizontally polarized electric dipole antennas buried in the earth. Such underground transmission of signals is inherently susceptible to significant signal attenuation due to the large dielectric coefficient and high conductivity of the earth. This is due to the fact that in a conductive (i.e., lossy) medium such as the earth or water, energy is dissipated through currents that are generated by the electric and magnetic field components of the wave. This energy loss results in an appreciable exponential attenuation of field strength with distance. In contrast, electromagnetic waves propagated through the atmosphere lose little energy to the medium. Thus, excess attenuation beyond inverse $R^2$ loss is negligible in the atmospheric case except at microwave and higher frequencies.

In order to achieve system hardness while utilizing the atmosphere for signal transmission, several past proposals have involved the positioning of half wave or smaller dipole antennas upon or beneath the surface of the earth. Such systems have experienced significant reduction in signal strength as compared with aboveground, vertically oriented dipole or monopole antennas as a result of signal attenuation and losses in the earth.

Comparisons of the performance of subsurface dipole antennas to conventional above surface antennas are presented in Fenwick and Weeks, *Submerged Antenna Characteristics,* I.E.E.E. Transactions on Antennas and Propagation, p. 296 (May, 1963), where it is seen that in many common situations the strength of the underground produced signal is more than 40 dB weaker than the signal produced by the reference antenna, which is a perfect quarter-wave vertical monopole antenna. Such reduced signal power is simply not acceptable for many communications systems applications, especially when such applications may involve long-range signal transmission. In addition to the above problem, dipole antennas produce electromagnetic signals which propagate in directions generally normal to the longitudinal axis of the dipole antenna. As a result, much of the signal strength is directed substantially straight upwards or into the ground where it is lost, resulting in significant amounts of power loss and reduced efficiency in the communication system.

In order to provide an underground antenna system while transmitting usable signals through the atmosphere, it has been proposed in the prior art to employ a buried loop antenna for generating a horizontally polarized magnetic wave which in turn generates a surface wave having a vertically polarized electric component to be received by a vertical whip receiving antenna. Although a substantial portion of the resulting signal propagates along the earth's surface, this antenna system still is very low in efficiency which is mainly a result of the use of horizontally polarized waves and the losses associated therewith. Another disadvantage of this type of prior art antenna is the very large physical antenna size needed at LF, MF and low HF frequencies.

Another means for obtaining system hardness while providing for transmission and reception of electromagnetic signals through the atmosphere would be to utilize a buried wire loop which could produce vertical plane polarized electromagnetic signals. In this way, no losses would be experienced due to horizontally polarized signals. However, it is well known that the size of such an antenna is directly related to the wavelength of the signal in earth at the frequency of operation. In fact, for optimal operation the perimeter length of the underground loop antenna should be approximately 1.4 wavelengths in earth at the operating frequency. For an operating frequency in the MF range of 400 KHz, the necessary loop antenna perimeter length would be approximately 100 meters. It becomes immediately apparent that, even if physically possible, the cost of trenching, supporting and burying such an antenna in the vertical position would make use of the antenna unrealistic if not impossible.

A further problem that is common to all underground antennas is the lower power gain which is experienced as a result of signal attenuation prior to signal entry into the atmosphere. Although this attenuation can be minimized by positioning the antenna close to the surface, it still exists in significant amounts. No adequate method has heretofore been found for substantially increasing the gain of atmospheric transmission signals emanating from an underground source and thus, this reduced performance capability has continued to be a longstanding, unresolved problem in the art.

Still a further problem with the use of underground antennas is that, although they are very hard in a military sense, installation of the underground antennas designed for low and medium range frequency operation typically requires extensive amounts of digging or drilling within the earth, which can consume considerable amounts of time. As a result, such systems typically find application only in situations requiring relatively permanent location of the antenna systems. Thus, a longstanding need continues to exist for an antenna system having a high degree of military hardness, and being usable for long distance communications, which may be quickly deployed at temporary locations, and which is easily transportable between such locations.

A specific need for a low profile antenna system which has capabilities in the medium and high frequency ranges exists where communications utilizing electromagnetic signals are necessary from remote locations not accessible by motorized vehicle. A typical example of such a situation arises in military circumstances when troops are parachuted into remote and often hostile regions. In these circumstances, and antenna system capable of being transported relatively easily by an individual soldier and having medium to high frequency range capabilities while being rapidly deployable and easily camouflaged would be very desirable. Clearly, the antenna configurations previously described do not even address, let alone satisfy, these important and unfulfilled needs.

In light of the above considerations, it is apparent that the great need that has heretofore gone unsatisfied is to provide a two-way, compact, easily transportable, quick deployment low profile wireless communication system capable of effectively receiving and transmitting signals over a wide band of frequencies, with the system being reasonably "hard" in a military sense. The system should have reduced vulnerability to jamming and, even immediately following a nuclear explosion, should permit long distance transmission of electromagnetic signals with reasonable data rates. The system should be capable of transmitting communication signals in either broad or narrow beam configurations, and in conjunction with enhanced signal processing, should be capable of performance comparable to existing conventional aboveground antenna systems. Furthermore, the system should feasibly permit redundancy sufficient to satisfy the need for system security without excessive costs. The underground communication systems heretofore employed have not been able to satisfy these important needs.

BRIEF SUMMARY AND OBJECTS OF THE INVENTION

The present invention advantageously provides a unique two-way, wireless communication system and method that employs a small, lightweight, quickly deployable surface or low profile current driver arrangement for sending and receiving electromagnetic signals propagated through the atmosphere. The system is operable on a wide frequency band in either bidirectional or unidirectional modes, and produces steerable signals having a power gain and data rates comparable to signals transmitted from more conventional aboveground systems.

The present invention involves use of at least one current driver comprising a pair of conductors and a balun positioned flat upon the earth's surface, or positioned above but in proximity to the earth's surface along at least a portion of its length. The elements of the current driver are constructed so that they are capacitively coupled with the surrounding earth in a manner such that induced ground currents cause the current driver and the earth to effectively function together as a vertical plane polarized antenna. A vertically polarized signal is transmitted from this antenna into the atmosphere where it continues to propagate as a vertically polarized wave.

In one preferred embodiment, the two current driver conducting arms are each comprised of insulated metallic tapes which are extendable and retractable onto a spool within a tape housing. The tapes and the spools in which they are housed are of a size and construction similar to the metallic measuring tapes which are widely used in the construction industry. The tapes are each connected at their leading ends to opposite terminals of a balance-to-unbalance ("balun") impedence matching transformer which is mounted within a current driver housing. When the current driver is thus configured, with the conducting arms each extended approximately equal distances upon the ground with the total length of the conducting arms greater than a half of a wavelength, and with the impedance of the current driver and earth approximately matched or correlated to that of a transmitter/receiver connected thereto, the capacitively coupled current causes the current driver and the earth to effectively function either as a vertical plane loop antenna or as a long-wire guided wave which produce a bidirectional vertically polarized electromagnetic signal. In their retracted state, the tape spools are compactly secured with the balun in the current driver housing.

In another preferred embodiment, the two current driver conducting arms are each comprised of one or more parallel wires or cable and are connected at their adjacent ends to opposite terminals of the balun. The balun and conducting arms are secured within a belt shaped length of material such as canvas so that the current driver may be rolled up for storage and transport. In operation this embodiment functions in substantially the same manner as the other preferred embodiment described above.

In still another preferred embodiment, the length of one of the two above-described current driver conducting arms is substantially shorter than the other conducting arm. A length ratio for the arms of approximately 2 to 1 has been found to be adequate for many applications, while larger ratios provide still further improvement in antenna gain. In this configuration, the capacitively coupled current causes the current driver and the earth to effectively function as a traveling wave antenna which produces a substantially unidirectional vertically polarized electromagnetic signal. For a length of 2 to 1 the power gain is approximately 4 dB greater than the bidirectional signal produced by the above-described embodiments.

Power gain in each of the embodiments is further improved by positioning several current drivers parallel to one another and at spacings which may be as close as half a skin depth in ground. These are fed in parallel using a power splitter and appropriate coax lines.

Parallel conducting lines sometimes referred to as tree elements may be affixed to the ends of the current driver conducting arms to move the capacitive coupling further out toward the ends of the arms, thus reducing by as much as one-third the current driver length required to receive or transmit at a given frequency. These tree elements are also important for improving coupling at the lower frequencies.

Further improvement in operating efficiency is achieved in the surface deployed system by placing porous, low conductivity material below the central portion of the current driver. By this means, losses are reduced and the induction of undesirable ground currents close to the current driver's center is substantially prevented. A drainage means may be positioned below the low conductivity material to prevent pooling of water around the current driver and to provide for all weather operation. This result may also be obtained by supporting the center portion of the current driver above the surface of the earth on nonconducting posts, stakes or similar members at a height of about one or two feet above the ground.

Accordingly, it is a primary object of the present invention to provide a low profile communication system and method which permits high quality, two-way communication while being relatively "hard" in a military sense.

It is still another object of the present invention to provide a long distance communication system which is small in size, hand transportable and which may be rapidly deployed in substantially any location or terrain.

It is also an object of the present invention to provide for high quality, long distance atmospheric transmission of communication signals between low profile sending and receiving terminals.

It is still another object of the present invention to provide a communication system having low profile sending and receiving terminals capable of sending and receiving signals on a wide frequency band at data rates which are comparable to typical aboveground communication systems.

It is a further object of the present invention to provide a communication system having low profile sending and receiving terminals which are configured so as to significantly reduce the current driver length required to transmit and receive at specified frequencies.

Another object of the present invention is to provide a low profile communication system which may be configured to produce either bidirectional or unidirectional vertically polarized electromagnetic signals and which may be operated in substantially all weather conditions without significant degradation of signal quality.

It is still another object of the present invention to provide a communication system which has a low susceptibility to jamming or to interfering electromagnetic radiation.

Still a further object of the present invention is to provide a long distance communication system using a surface proximity deployed current driver arrangement which makes redundancy for purposes of system security economically feasible.

It is still another object of the present invention to provide a communication system which is low in initial cost and which has a very low maintenance cost, thus making the system highly desirable in both military and commercial broadcasting and receiving systems.

Another valuable object of the present invention is to provide a high power, long distance, surface proximity deployed communication system which does not degrade the surrounding environment, and which is easily camouflaged.

These and other objects and features of the present invention will become more fully apparent from the following description and appended claims taken in conjunction with the accompanying drawings.

BRIEF DESCRIPTION OF THE DRAWINGS

FIG. 1 is a schematic illustration of a ground surface deployed current driver which embodies the principles of the present invention.

FIG. 2 is a graph which represents a wire loop antenna input resistance as a function of the length of the loop antenna perimeter in wavelengths when the loop antenna is located in air.

FIG. 3 is a graph which represents input reactance as a function of the length of the loop antenna perimeter in wavelengths when the loop antenna is located in air.

FIG. 4 is a schematic illustration of the current driver of FIG. 1 with current and voltage magnitudes represented next to the current paths for the case where the loop is approximately matched to the impedance of the signal source at approximately 1.4 wavelengths.

FIG. 5 is a partial cut away view of one preferred embodiment of the current driver system of the present invention, illustrating the current driver in its retracted configuration.

FIG. 6 is a side elevation view of the current driver system of FIG. 5.

FIG. 7 is a top plan view of the current driver system of FIG. 5, illustrating the current driver in its partly deployed configuration.

FIG. 8 is a schematic illustration of one preferred embodiment of a ground surface deployed current driver which embodies the principles of the present invention.

FIG. 9 is a top plan view of the ground surface deployed current driver of FIG. 8.

FIG. 10 is a top plan view of the ground surface deployed current driver of FIG. 9, with the resulting electromagnetic signal wave pattern superimposed thereon.

FIG. 11 is a schematic representation of another preferred embodiment of the present invention comprising a ground surface deployed current driver array having several current drivers positioned in parallel.

FIG. 12 is a top plan view of the current driver array of FIG. 11.

FIG. 13 is a top plan view of the current driver array of FIG. 12 with the resulting electromagnetic signal wave pattern superimposed thereon.

FIG. 14 is a schematic representation of another preferred embodiment of the present invention comprising a ground surface deployed current driver array, with extensions of the parallel current drivers configured as conductive tree terminations.

FIG. 5 is a top plan view of the ground surface deployed current driver array of FIG. 14.

FIG. 16 is a top plan view of a ground surface deployed current driver array such as that of FIG. 14, with the resulting electromagnetic signal wave pattern superimposed thereon.

FIG. 17 is a top plan view of another embodiment of the present invention, comprising a low profile deployed switched current driver array capable of transmitting signals over a relatively wide band of frequencies.

FIG. 18 is a schematic representation of another preferred embodiment of the present invention comprising a unidirectional ground surface deployed current driver embodying the principles of the present invention.

FIG. 19 is a top plan view of the unidirectional current driver of FIG. 18, with the resulting electromagnetic signal wave pattern superimposed thereon.

FIG. 20 is a top plan view of a unidirectional current driver array, with the resulting electromagnetic signal wave pattern superimposed thereon.

FIG. 21 is a schematic illustration of one preferred embodiment of a ground surface deployed current driver in combination with a cancellation current barrier embodying the principles of the present invention.

FIG. 22 is a schematic illustration of one preferred embodiment of a partially elevated bidirectional current driver embodying the principles of the present invention.

FIG. 23 is a schematic illustration of one preferred embodiment of a partially elevated unidirectional current driver embodying the principles of the present invention.

FIG. 24 is a schematic illustration of another preferred embodiment of a partially elevated unidirectional current driver embodying the principles of the present invention.

FIG. 25 is a top plan view of another preferred embodiment of the current driver system of the present invention, illustrating the current driver and associated switching equipment secured in a belt arrangement.

FIG. 26 is a graph which represents the signal wavelength in the earth as a function of frequency.

FIG. 27 is a graph which represents the signal penetration or skin depth in the earth as a function of frequency.

DETAILED DESCRIPTION OF THE PREFERRED EMBODIMENTS

Reference is now made to the drawings wherein like parts are designated with like numerals throughout.

1. General Discussion

The communication system of the present invention may be generally described by reference to FIGS. 1 through 4. With particular reference to FIG. 1, it is seen that a current driver (generally designated at 100) is positioned in proximity to the earth's surface 11. Current driver 100 is configured similarly to a dipole, in that it has first and second conducting arms 102 and 104 respectively, positioned in end-to-end relationship but separated from electrical contact. Conducting arms 102 and 104 are protected about substantially their entire exterior surface by a sheath of electrical insulating material such as teflon or one of many other commercially available electrical insulators. By this means direct electrical contact with the earth 11 is prevented, while capacitive coupling of the current driver 100 to the earth 11 is encouraged.

The adjacent ends of conducting arms 102 and 104 are connected to a balun 106 that provides impedance matching as well as balance-to-unbalance transformer action in a manner to be described more fully hereinafter. Balun 106 is additionally connected by means of a coax cable to a signal source (not shown) which typically comprises a conventional transmitter/receiver and which can generally be positioned either close to or remote from the current driver 100. The balun 106 preferably should be capable of approximately matching all impedance values of the current driver 100 and the earth 11 which may exist beyond one wavelength of the operating frequency to the impedance of the signal source.

When the impedance of the current driver 100 and earth 11 are approximately matched by use of balun 106 to the impedance of a signal source (not shown), ground currents 108 are induced into the surrounding earth 11 through current driver 100. If the length of conducting arms 102 and 104 is sufficiently long, ground currents 108 will define a loop whose perimeter is of a size sufficient to cause the earth 11 and current driver 100 to essentially function together as a vertical plane polarized antenna. The physical means by which this is accomplished may best be described by reference to FIGS. 2 through 4.

FIG. 2 illustrates the input resistance of a square wire loop antenna in air as a function of the loop perimeter, while FIG. 3 illustrates the input reactance of such an antenna. The peak values of resistance and reactance are reduced when the wire loop antenna is near or below the earth surface. The loop made up of the current driver and earth would typically have peak resistance and reactance less than 500 ohms. The frequency characteristics remain the same. Dipole radiators are generally half wave in length at a given operating frequency, and are operated at a frequency close to the point where the reactance is near zero ohms. This point is illustrated at location 112 in FIG. 2 and at 113 in FIG. 3. In this situation, a center-fed dipole antenna will have maximum currents and minimum voltage levels at the center feed point, and minimum current with maximum voltage levels at the ends of the conducting arms. Maximum signal radiation will thus occur outwardly in a direction substantially normal to In contrast, the current driver 100 of the present system is operated in the region above one wavelength perimeter where the resistance and reactance are high. This is essentially opposite to the above-described operating conditions for a typical dipole antenna. In this case, the impedance of the current driver 100 and the earth is approximately matched to that of the signal source (normally a transmitter/receiver), by means of the balun and impedance transformer 106. The current driver 100 is configured so as to have an overall length which is sufficient to induce ground currents into the earth 11 by means of capacitive coupling so as to form a current loop having a perimeter which is in excess of one wavelength in the ground at the system operating frequency. The current driver operating range in which this result can be accomplished includes substantially all conditions where the wavelength is greater than one, as is partially illustrated at 114 in FIG. 2 and at 115 in FIG. 3. The point at which the current driver and the earth operate optimumly as a loop is indicated at 116 in FIG. 2 and at 117 in FIG. 3. This position defines a current loop perimeter which is just less than 1.5 wavelengths of the operating frequency in the earth. The system also approaches peak operating conditions at just less than the half wavelength point between each additional full wavelength (i.e. 2.5, 3.5, 4.5 et. seq.). When the length of the current driver 100 exceeds about one wavelength, the antenna formed by the current driver 100 and the earth begins to operate as a long-wire guided wave antenna with greatly increased antenna gain.

The particular voltage and current waveforms which are present when current driver 100 is operated at operating point 116 can be described by reference to FIG. 4. In this operating condition, the primary current path induced by current driver 100 is illustrated at 127. The voltage field produced when current driver 100 is operated at point 116 is illustrated at 122 and the current magnitude is illustrated at 118. In this operating configuration it can be seen that voltage minimums occur near the positions identified at 125. The relationship of voltage on antenna element 100 causes a resulting ground current to be induced in the earth by means of capacitive coupling; the resulting current forming a loop 127 which extends into the earth 11, with the ends of loop 127 coupled to the current driver 100 in the vicinity of 128. The current in loop 127 additionally travels along the body of current driver 100 in the direction illustrated by the arrows in FIG. 4, so as to form a vertical plane loop.

It should be noted that the position along current driver 100 of the current maximum and voltage minimum 125 varies in response to variation of frequency, being at the center for one wavelength loop perimeter and moving outward toward the ends as the frequency increases. Thus, for proper operation the current driver 100 should be of sufficient length to permit capacitive coupling in the preferential coupled region of the driver 100.

When the length of the current driver 100 is long compared to a wavelength there is a substantial increase in performance or gain due to the current driver and earth acting as a long-wire guided wave antenna. Thus there is a low peak response when the loop perimeter is about 1.4 wavelengths, followed by a partial null when the loop perimeter is about 2 wavelengths. This is then followed by a substantial increase in antenna gain as the antenna begins to operate as a long-wire guided wave antenna. Performance typically continues to increase with increasing frequency until a maximum is reached in the 15 to 20 MHz range. The gain then slowly drops off with increasing frequency because antenna losses increase faster than directional gain.

Examples of convnetional aboveground long-wire guided wave antennas are set forth in chapter 5 of *Antenna Theory and Design,* (pages 239–244) by Warren L. Stutzman and Gary A. Thiele (John Wiley and Sons 1981).

The current and voltage relationships described above remain substantially the same for given earth conditions, and for current drivers of a given length, no matter whether the current driver is positioned upon the surface of the earth as illustrated in FIG. 4, or whether it is buried beneath the surface of the earth close to the interface, or whether it is positioned so as to have a portion of its length in proximity to but above the surface of the earth.

Particular examples of several preferred embodiments of the low profile configuration of the current driver 100 are more fully described hereinafter. Examples of underground configurations of current drivers which embody the principles of the present invention are outlined in my copending applicaton entitled "Wireless Communication System and Method Using Current Formed Underground Vertical Plane Polarized Antennas", Ser. No. 393,043, filed on June 23, 1982, which is incorporated by reference herein.

2. The Surface Deployed Tape (FIGS. 5 through 10)

One preferred embodiment of the communication system of the present invention includes a retractable current driver as illustrated in FIGS. 5 through 10. The physical characteristics of the retractable tape embodiment can best be described by reference to FIGS. 5 through 7.

Referring specifically to FIG. 5, it is seen that the current driver 50 includes a current driver housing 52 constructed of durable, lightweight material such as plastic, and configured so as to secure the retracted current driver arms within. Secured within housing 52 adjacent to its central lower sides is a balun that provides impedance matching as well as balance-to-unbalance transformer action, as described in the text *Solid State Radio Engineering,* (pages 371 to 378) by Herest L. Krauas, Charles W. Bostian and Frederick H. Roaf (John Wiley and Sons 1980). As hereinafter more fully explained, this impedance matching technique greatly improves the performance of the communication system.

Extending outward from balun 17 through an aperture in the lower side of housing 52 is a coax cable connector 54. Connector 54 extends outward from housing 52 so as to provide for easy connection of a coax cable (not shown) through which the system is supplied RF energy.

Positioned on the upper interior face of balun 17 are terminals 56 and 58. Permanently connected to terminal 56 is the leading end of a current driver conducting arm 16, while permanently connected to terminal 58 is the leading end of another current driver conducting arm 18. By means of their connection to terminals 56 and 58, conducting arms 16 and 18 may be electrically connected through balun 17 and connector 54 to a signal source (not shown) which typically comprises a conventional transmitter/receiver system.

In the preferred embodiment, current driver conducting arms 16 and 18 are comprised of thin, metallic tape such as that which is utilized in a typical carpenter's measuring tape. These tapes are preferably approximately ⅜" to 1" wide. It will be understood that for improving capacitive coupling toward the distant ends of arms 16 and 18, wider tapes may be desirable. Likewise, for operation in the higher frequency ranges, narrower tapes may be utilized as desired.

Conducting arms 16 and 18 are electrically insulated along substantially their entire exterior surface. This insulation may be formed by immersing the conducting arms in a liquid bath of electrical insulating material, removing the arms therefrom and then permitting them to dry. Other methods are also known and used for providing such protection. The conducting arms 16 and 18 are also typically painted with a camouflage color and are imprinted with appropriate frequency identification information so as to provide for quick deployment.

Conducting arms 16 and 18 are secured at their distal ends, respectively, to the central shaft of crank wound tape cases 60 and 62. In the retracted position illustrated in FIG. 5, conducting arms 16 and 18 are stored in a coil configuration within cases 60 and 62, having been wound around the shaft within those cases in accordance with well-known methods of storing lengthy measuring tapes within crank wound tape cases.

Tape cases 60 and 62 are secured within the housing 52 by frictional pressure applied by a case retaining bar 64 which is secured to the interior face of the tape of housing 52. In operation, as cases 60 and 62 are inserted within housing 52, bar 64 contacts one face of each of cases 60 and 62, and forces the other face of those cases against the opposite interior wall surface of housing 52.

By reference to FIG. 6, it is seen that the connector 54 is maintained in its extended position by means of a threaded connection with a retaining nut 66 which is positioned about the connector 54, and adjacent the exterior side surface of housing 52.

FIG. 7 comprises an illustration of the physical appearance of current driver 50 in a partly deployed mode. Current driver 50 is deployed by placing the housing 52 upon the ground and removing tape cases 60 and 62 therefrom through the respective open ends of housing 52. The conducting arms 16 and 18 are respectively unwound from cases 60 and 62 and translated outward into the operational configuration as those cases are removed from the vicinity of housing 52. After extension from the cases 60 and 62, conducting arms 16 and 18 are positioned upon the surface of the ground in a substantially straight, end-to-end configuration.

For ease of description, further figures comprising schematic illustrations of the above-described low profile current driver system will not depict the tape case 52, but will illustrate the connection of the conducting arms 16 and 18 to the balun 17.

By reference to FIGS. 8–10, the operation of the low profile communication system of the present invention may be described. It is noted that, although current driver 50 appears to be physically constructed as a dipole, when the impedance of the current driver 50 and earth is adjusted so as to be approximately matched or correlated to the impedance of the transmitter/receiver 13 (see FIG. 9), and when arms 16 and 18 are of a length sufficient to induce a current loop in the earth having a perimeter length greater than one wavelength of the electromagnetic signals in earth, then current driver 50 does not act as a dipole antenna. Under these conditions, the interaction between the current driver 50 and the surrounding earth causes current driver 50 and the earth to effectively function together as a vertical plane polarized loop antenna or a long-wire guided wave antenna which produces a vertically polarized electromagnetic wave. The current loop is formed as a result of capacitive coupling which occurs between the earth and the conducting arms 16 and 18 of current driver 50. For good performance, the capacitive reactance must be small with respect to the current driver resistance.

The current loop action in this embodiment is illustrated by reference to FIGS. 8 and 9. Electrical currents flow in a vertical path 15 which is directly beneath current driver 50, while they also are produced somewhat outward therefrom in a spread configuration as illustrated by the top view of loop paths 23 of FIG. 9. However, as indicated by the directional arrows in FIG. 9, the electromagnetic waves forming current loop paths 23 travel in opposite directions, depending on their orientation with respect to the position of current drive 50. Thus, currents in flow paths 23 substantially cancel each other so that only the vertical loop described by current path 15 remains. In situations where the current driver 50 is buried in the ground, conduction currents 15 and 23 flow on all sides, resulting in a lower system operating efficiency due to energy lost in producing the currents, which cancel each other as explained above. With the current driver 50 positioned upon the ground surface, the majority of such cancellation currents are effectively eliminated.

In operation, the electrical current from the generator of transmitter/receiver 13 is conducted through coaxial cable 14 to balun 17 and from balun 17 to conducting arm 16. Conducting arm 16 is capacitively coupled to the earth upon which it is positioned so that the current is caused to travel therethrough along current loop paths 15 and 23 to the other conducting arm 18, which is also capacitively coupled to the earth so that the current passes into that conducting arm. From conducting arm 18 the current is returned through balun 17 and coaxial cable 14 to the generator of transmitter/-receiver 13. Thus, the uncancelled lower ground currents act together with conductive arms 16 and 18 to define a vertical plane loop which produces vertically polarized electromagnetic signals.

It has been found that the low profile communication system of this invention functions properly at current driver/earth combination impedances which correspond to current loop perimeters which are greater than one wavelength in size at the operating frequency in the earth. System performance approaches a peak when the current loop perimeter is approximately 1.5 wavelengths in size, while other peak performance regions are found at each additional full wavelength increase from this value (i.e. at wavelengths of 2.5, 3.5, 4.5, et. seq.). The long-wire guided wave antenna of the current driver conductors 16 and 18 further improve performance when the loop path length exceeds about 2.5 wavelengths. By using balun 17 to match or correlate the impedance of the current driver and earth to the impedance of the transmitter/receiver 13 and coaxial cable 14, a maximum power transfer may be realized. Of course, balun 17 must have the capability of approximately matching the impedance of current driver 50 and earth 11 to that of the transmitter/receiver at wavelengths of greater than one for signals in the earth, and preferably balun 17 can accomplish the impedance matching at substantially all wavelengths greater than one for such signals.

The bandwidth operation of the communication system of this invention becomes fairly large when using a transmission line transformer balun. Bandwidths of as much as three octaves have been demonstrated. An example is a 3 to 30 MHz system for HF operation. Other well known, commercially available impedance matching circuits may also be used for accomplishing the desired impedance matching, although some may tend to have reduced bandwidth.

FIG. 10 illustrates a typical azimuth pattern of the current driver 50. The azimuth wave pattern for this and all bidirectional single current driver embodiments of the present invention is a figure eight pattern with lobes 40 in line with the axis of current driver 50 and with a deep null 41 normal to the axis of current driver 50. For loops that are less than two wavelengths, the 3 dB beam width of this pattern is about 90 degrees and thus one such bidirectional current driver configuration produces a signal wave which covers two 90 degree sectors for a total coverage of 180 degrees. For larger loops and guided wave action the beam angles are reduced. The elevation pattern (not shown) is that of a conventional vertical loop antenna for loop sizes less than two wavelengths. More complete patterns are produced for larger size loops. Typically, in a single current driver embodiment, the signal wave radiation along the surface of the earth is less by about 3 to 6 dB than at the peak of the pattern, with this value being variable with signal frequency and with the conductivity and dielectric constant of the earth. The radiated polarization near the earth's surface is vertical, as is necessary for efficient ground wave propagation.

3. The Low Profile Current Driver Array (FIGS. 11 through 13)

Efficiency of communication systems using the current driver of this invention can be improved by using multiple current drivers 50 connected in a configuration such as that illustrated in FIG. 12. To form a current driver array two or more current drivers 50 are configured so that their conducting arms 16 and 18 are respectively in parallel alignment, both vertically (see FIG. 11) and horizontally (see FIG. 12). In the illustrated embodiment four identical current drivers 50 are shown, although of course the number may vary as a matter of design choice and system requirements. The individual current drivers 50 are fed with power of the same amplitude and phase. This is accomplished by using a conventional power splitter 30 connected to a balun 17 for each current driver 50 connected by coaxial cables 14. A typical impedance transformation ratio for the baluns is 9 to 1 when using a 50 ohm coax. In contrast for conventional dipole applications, balun impedance transformation ratios are typically about 1 to 1. It is important that the interconnecting coaxial cables 14 between baluns 17 and power splitter 30 be of equal length so that current driver elements 50 are fed with power of the same phase angle.

Each of the individual current drivers 50 in the array function with the earth as a vertical plane polarized antenna in the same manner as the current driver 50 which was previously described in connection with FIGS. 8 through 10. With the current drivers 50 connected and balanced as illustrated in FIG. 12, and with proper parallel spacing between the current drivers 50, the power gain and efficiency of the current driver array becomes a direct multiple of the number of current drivers contained in the array. For example, the power gain and efficiency of an array containing four current drivers is approximately four times the power gain and efficiency of a single low profile current driver.

The parallel spacing between the current drivers in the array is an important design consideration in achieving improved power gain and efficiency. For wide beam operation the basic requirement is that the entire width of the parallel array be no more than half a wavelength in air at the system's operating frequency. If the current driver array exceeds this dimension, the transmitted signal beam pattern becomes proportionately reduced. On the other hand, the parallel current drivers 50 may not be positioned so close to each other as to experience significant mutual impedance or other coupling effects between the adjacent current drivers.

The size and spacing of an aboveground antenna array are quite different from that of the present invention. For example, at 400 KHz the wavelength in air is 750 meters. Typical required spacing of parallel antennas aboveground would be half a wavelength or 375 meters. Mutual impedance effects would begin occurring at spacings which are only a little less than this.

In contrast, at 400 KHz the wavelength propagated through the ground is in the range of 100 meters or less and thus the half wavelength spacing would be about 50 meters. However, current drivers of the type described herein experience essentially no significant mutual coupling even at parallel spacings as close as approximately a skin depth. Spacings as close as half a skin depth have been used effectively. A skin depth is the distance at which an electromagnetic wave would attenuate by $e^{-1}$, where e is the base of the natural logarithm (2.718). For typical low conductivity soils, one skin depth is on the order of 10 meters at high frequencies and 40 meters or more at low frequencies (see, e.g., FIG. 27 for typical values of skin depth). Thus, with the present invention it is possible to produce a communication system with a very high power gain and high signal quality using a low profile current driver array which occupies a relatively small area. This is one of the principal advantages of the present invention.

With reference to FIG. 13, it is seen that the signal pattern 40 of the current driver array is virtually the same as that of the single current driver 50 (see FIG. 10) so long as the overall current driver array width does not exceed half a wavelength in air at the operating frequency of the system. If the array width exceeds this value, then the azimuth beam angle will decrease as in conventional antenna arrays located aboveground.

The current driver array has the additional advantage that its signal pattern 40 (see FIG. 13) may be steered with the use of conventional phase shifters (not shown). Phase shifting is accomplished by varying the phase relationship of the current drivers using conventional methods known in the communications industry. Since jamming is normally generated from a particular direction, it may be avoided by use of narrow beams and by steering the signal pattern of the array in a direction other than that of the jamming signal source. Thus, the steerable wave pattern of the current driver array makes this arrangement more secure for military purposes than the single current driver embodiment. Since atmospheric noise is often generated from a particular direction, narrow beams and steering also permit the effects of such noise to be greatly reduced by not steering the signal pattern in the direction of the noise.

4. The Low Profile Current Driver Array With Tree Terminations (FIGS. 14 through 16)

Due to the physical effects of the earth in terms of shortening the wavelength of a signal propagated through the ground as opposed to the air (typical reductions range from one-half to one-tenth, depending on frequency, conductivity of the earth, and dielectric constant of the earth), the size of the earth antennas which are formed as described herein are significantly less than the size required for conventional aboveground antennas to operate at similar frequencies, and thus the length of the low profile current driver is small when compared to those typical aboveground antennas. Even so, the length of the current driver is still rather large at low frequencies.

One important requirement of the system of the present invention is that the coupling reactance between the current driver and the ground must remain small at all frequencies. It has been found that at lower frequencies the current driver capacitance must be increased to keep the reactance as low as needed. Capacitance is a function of the current driver conductor dimensions, the number of conductors in parallel, and the conductive characteristics of the surrounding ground. Thus, as the frequency goes down, it becomes necessary to add size to the current driver or to add parallel conductors in order to increase the capacitance for purposes of keeping the reactance low.

As illustrated in FIGS. 8, 11, and 14, the vertical ground currents 15 are generally transmitted from locations along the outer mid section of conducting arms 16 and 18. Thus, the mean path for capacitive coupling tends to be toward the middle of the conducting arms 16 and 18. As the length of conducting arms 16 and 18 is increased in order to transmit and receive at lower frequencies, capacitive coupling tends to occur further out along the arms 16 and 18. However, the mean location of the capacitive coupling continues to be at approximately the mid point of conducting arms 16 and 18.

Since the true frequency of system operation is determined by the current paths, and since the location of maximum capacitive coupling along the conducting arm identifies the current path, it is the location of capacitive coupling and not entirely the actual current driver length which ultimately defines the operating frequencies for a particular current driver configuration. In light of these considerations, if the location of capacitive coupling can be brought closer to the ends of the conducting arms 16 and 18, then the required length of the actual current driver necessarily will be less.

One way of moving the capacitive coupling closer to the ends of conducting arms 16 and 18 is to use the tree terminations generally designated 32, and shown best in FIG. 15. Tree terminations 32 can be comprised of the same materials as comprise the conducting arms 16 and 18. The terminations 32 are positioned parallel to each other and are attached to the ends of conducting arms 16 and 18. In the alternative, suitable terminations may be constructed using insulated metal plates or screens (not shown) or a single insulated conductor which is attached to the end of conducting arms 16 and 18 and extends coaxially therefrom. Terminations 32 may be used on the ends of a single current driver or they may be used in a current driver array as illustrated in FIG. 15. The spacing of the individual conductors 33 within each tree termination 32 is not critical.

The number of separate conductors 33 used in each tree termination 32 and the length thereof is a function of the capacitance of the conductors 33. As more conductors 33 are connected in parallel, the overall length of the tree terminations 32 may be reduced. The actual determination of conductor quantity and termination length is strictly a function of the amount of capacitance necessary for adequate coupling and to locate the capacitive coupling at a position on conducting arms 16 and 18 which will permit operation of the communication system at the desired frequency.

Without the tree terminations 32, the minimum necessary overall length of the conducting arms 16 and 18 is typically on the order of about one wavelength as measured in the ground medium at the system operating frequency. With tree terminations 32 the optimum overall length of conducting arms 16 and 18 may be on the order of two-thirds to three-quarters of one wavelength as measured in the ground medium at the system frequency.

Except for the tree terminations 32 as described above, which have the effect of permitting the overall length of each individual current driver to be shortened somewhat, basic operation of the array illustrated in FIGS. 14 through 16 is the same as the current driver array previously described in connection with FIGS. 11 through 13. That is to say, the array with tree terminations 32 also functions in combination with the earth as a vertical plane polarized loop antenna array or long-wire guided wave array by virtue of capacitive coupling between each individual current driver 50 and the surrounding earth.

With reference to FIG. 16, the azimuth pattern 40 is virtually identical to the signal pattern (see FIG. 13) of the array described in connection with FIGS. 11 and 12.

5. The Wide Band Switched Array (FIG. 17)

Military communication requirements include systems which operate at VLF, LF, MF, HF, and VHF. With the present invention it is possible to operate at any or all of these frequencies in a single system installation. FIG. 17 illustrates one means for accomplishing this type of wide band operating capability using the principles of the present invention.

The embodiment of FIG. 17 includes a control center 70 which contains a transmitter/receiver (not shown) as well as a conventional power splitter (not shown) together with other electronic control circuitry (not shown) for controlling the system operation as hereinafter more fully described. The control center 70 is connected to the various current driver elements generally designated at 72–76 by means of coaxial cable 14.

In the illustrated embodiment, various types of current driver elements 72–76 are used in combination. For example, the current driver elements 72 comprise low profile current drivers which are similar in their construction and basic operation to the low profile current driver embodiment previously described in connection with FIGS. 8 through 10. The current drivers 72 each have a pair of conducting arms 78 and 80 which are connected to an impedance matching circuit 17 which may be, for example, a balun. The conducting arms 78 and 80 may consist of insulated conducting tape of a type corresponding to that previously described or used as conducting arms 16 and 18 of FIG. 8. Alternatively, conducting arms 78 and 80 may comprise other conductive material such as copper, aluminum cable or wire. The length of each conducting arm 78 and 80 is approximately 300 meters. At this length, current drivers 72 are designed to operate in the frequency range of 40 KHz to 100 KHz.

Current driver 73 is also a low profile current driver. The current driver 73 includes two identically configured conducting arms generally designated at 82 and 84 which are placed end-to-end and which are connected to a balun 17 for purposes of matching the impedance of the conducting arms 82 and 84 to the impedance of the transmitter/receiver (not shown) located at the control center 70. For purposes of simplifying the illustration and description, only the elements of conducting arm 82 are described in detail and it will be understood that the opposite conducting arm 84 is identically constructed.

Conducting arm 82 consists of four lengths of conductors which may comprise insulated conductors 85–88 of a type corresponding to that previously described for use as conducting arms 16 and 18 of FIG. 8. Alternatively, conducting arm 82 may comprise other conductive material such as copper, aluminum cable or wire. Each length of conductor varies. For example, the length of conductor 85 is approximately two meters, conductor 86 is approximately two and one-half meters, cable 87 is approximately four and one-half meters and conductor 88 is approximately 286.5 meters. The lengths of conductors 85–88 are interconnected by a series of switching devices 90–94. Each switching device 90–93 may be, for example, a conventional electrical relay which can be activated from the control center 70 to connect or disconnect the various lengths of conductor 85–88.

The switching elements 90–93 may also be conventional pneumatic switches, relays or other suitable types of conventional switching devices. When using electrical relays as switches it is necessary to use RF chokes in the control lines at the current driver switching locations. The pneumatic switches with dielectric control lines avoid the use of RF chokes with resulting increased electromagnetic pulse (EMP) hardness.

The tree termination generally designated 94 is interconnected between the switching elements 92 and 93 and forms part of he conducting arm 82, along with the lengths of conductor 85–88.

In use, the various lengths of conductor 85–88 together with the tree termination 94 may be combined in various ways through the use of switching elements 90–93 to vary the length of the conducting arms 82 and 84 for purposes of permitting the current driver 73 to be used over a wide band of frequencies. For example, the length of conductor 85 is designed for operation in the range of 15 MHz to 30 MHz. By using the switching element 90 to add the length of conductor 86 to the length of conductor 85, the current driver 73 can be operated in the range of 8 MHz to 15 MHz. Similarly, by using switching element 91 to add the length of conductor 87 to the lengths of conductors 86 and 85, the current driver can be operated in the range of 3 MHz to 8 MHz. When switching element 92 is operated to add the tree termination 94 to the three lengths of cable 85–87, system operation is in the range of 1.5 MHz to 3 MHz.

Also, it should be noted that other current drivers such as the current drivers 74, 75 and 76 may be designed to include lengths of conductor, switching elements and tree terminations which are the same as the conductor lengths 85–87, tree termination 94 and switching elements 90–92 of current driver 73, with the net effect of creating a current driver array consisting of essentially eight identical current driver elements, depending on how each current driver element is switched. As previously explained, use of eight current drivers in an array will increase the signal gain by a factor of eight in the particular range of operating frequencies.

By adding the length of conductor 88 through the use of switching element 93, the current driver 73 becomes approximately the same in its length as current driver elements 72, and is thus capable of operating as part of a parallel array in the frequency range of 40 KHz to 100 KHz.

Other possible switching arrangements are illustrated in connection with the current driver elements 75 and 76. For example, current driver 75 includes a further tree termination generally designated at 96 which includes five conductors 97, each of which is approximately eighteen meters in length. When the tree termination 96 is switched so as to form a part of the conducting arm of the current driver element 75, the current driver 75 is operational in the frequency range of 350 KHz to 500 KHz. And, as illustrated by current driver element 76, a further extension 98 can be added onto the tree termination 96 to further increase the length of the current driver 76, thus permitting operation at even lower frequency ranges.

In the alternative, instead of varying conductor lengths by switching, a variable length current driver as previously described with reference to FIGS. 5 through 8 may be utilized with the conductor lengths being varied by manually drawing the conductive tape from the current driver housing 52, and retracting the conductive tape into housing 52.

It will be appreciated that the current driver configurations illustrated herein are simply presented for example purposes and it is contemplated that numerous array configurations and current driver arm length arrangements are possible. For example, by using terminal 70 as a center point, the various current driver arrangements can be positioned such that individual current drivers are oriented in specified directions such that signals transmitted therefrom propagate generally in the particular direction of current driver alignment. From the foregoing illustrative embodiment, it is apparent that the principles of the present invention can be advantageously used to design a highly flexible and efficient low profile communication system capable of wide band operation, and in conjunction with enhanced signal processing, capable of performance at data rates closely comparable to conventional aboveground wireless communication systems. The current drivers used in the array can optionally have variable length conducting arms and, when the current drivers are properly matched by the baluns 17 to the impedance of he transmitter/receiver, they will effectively operate with the earth as vertical plane polarized antennas. Moreover, by properly combining the various current driver elements of the array, signal gain can be materially enhanced.

6. The Unidirectional Low Profile Current Driver (FIGS. 18–20)

There are a number of significant advantages to having a low profile communication system which includes an earth antenna having the capability of end fire or unidirectional operation. These advantages include (1) reduced effects from noise and interference (jamming) originating from directions other than the desired communication direction; (2) increased transmit signal gain both from each current driver element, and from each array which utilizes this configuration; and (3) reduced production of interference in other communication units not in the desired communication direction. FIG. 18 illustrates one means for accomplishing this type of unidirectional operating capability using the principles of the present invention.

The embodiment of FIG. 18 includes a low profile current driver 200 having conducting arms 226 and 228 positioned in end-to-end alignment and connected at their adjacent ends to a balun 17 which provides impedance matching as well as balance-to-unbalance transformer action. Current driver 200 is positioned upon the surface of the earth 11 in the manner previously described so as to produce ground currents 208 which are induced through current driver 200 by means of a transmitter/receiver (not shown).

In the illustrated embodiment, it is seen that conducting arm 226 is substantially shorter than conducting arm 228. In this configuration, the communication system functions as a unidirectional antenna. It has been found that this communication system functions best as a unidirectional antenna when the length ratio between conducting arm 228 and conducting arm 226 is 2 to 1 or greater.

By reference to FIG. 18 it is apparent that the current loop path formed by currents 208 is not centered about the balun 17, but rather the current loop is significantly elongated in the direction of the longer conducting arm 228. Thus, the current loop formed by currents 208 through the earth and through current driver 200 causes the current driver 200 and the earth 11 to function as a traveling wave antenna in which the long conducting arm 228 in conjunction with the earth acts as a "slow-wave structure" which effectively controls the propagation direction of the wave produced by the basic loop antenna.

FIG. 19 illustrates a typical signal wave pattern 230 of the unidirectional current driver arrangement. The azimuth wave pattern for this current driver embodiment comprises an unbalanced figure eight pattern with the main or front beam being in line with the conducting arms of current driver 200, and propagating in the direction of the longer arm 228. The 3 dB beam angle for a single element as illustrated in FIGS. 18 and 19 is 40–60 degrees wide, depending upon frequency. As the communication system operating frequency increases, signal gain is found to increase and beam angle is found to become narrower.

The front-to-back lobe ratio for the unidirectional signal produced by a current driver 200 which has a 2 to 1 conducting arm length ratio as illustrated in FIG. 19 is typically about 10 dB. In this configuration, the signal bandwidth tends to be somewhat wider than the previously described bidirectional signal and thus the unidirectional system experiences a more uniform performance over the 2 to 30 MHz operating range. In addition, in the unidirectional operating configuration the lower cutoff frequency is controlled by the length of the shorter conducting element 226, and it has been found that the transmit signal gain for this configuration is approximately 3 to 10 dB higher than that in the bidirectional configuration, the exact amount depending upon the system operating frequency.

The unidirectional current driver configuration may be utilized in array form as illustrated in FIG. 20. The configuration of the array of FIG. 20 is substantially identical to the low profile loop array illustrated in FIGS. 11 through 13, with the exception that the length ratio of the conducting arms is modified as explained above. As with the bidirectional current driver array, the current drivers in the unidirectional array (four in this example illustration) are fed with power of the same amplitude and phase. This is accomplished by using a conventional power splitter 30 connected by coaxial cables 14 to a 4-to-1 balun 17 for each current driver 200. It is important that the interconnecting coaxial cables 14 between baluns 17 and power splitter 30 be of equal length so that the current drivers 200 are fed with the same phase angle.

The operating parameters for a unidirectional current driver array are substantially identical with those previously discussed with respect to the bidirectional current driver array configuration. Thus, for wide beam operation the basic requirement is that the entire width of the parallel array be no more than half a wavelength in air at the system's operating frequency.

Likewise, the degree of improvement in system performance of a unidirectional current driver array as compared with a single unidirectional current driver system is substantially identical to the improvement in performance experienced in the bidirectional current driver situation. Thus, with the current drivers 200 connected and balanced as illustrated in FIG. 21, and with proper parallel spacing between the current drivers 200, the power gain and efficiency of the current driver array becomes a direct multiple of the number of current drivers contained in the array.

Still further, as is the case in the bidirectional current driver situation, the signal pattern 234 of the unidirectional current driver array is virtually the same as the waveform 230 (FIG. 19) of the single unidirectional current driver, so long as the overall current driver array width does not exceed half a wavelength in air at the operating frequency of the system. The unidirectional current driver array of FIG. 20 also provides the advantage of steerability through the use of conventional phase shifters.

Because of its greatly improved gain at low elevation angles as compared to that of the bidirectional current driver arrangement, coupled with the further flexibility provided in the steerable current driver array arrangement, the unidirectional current driver configuration becomes particularly desirable in applications requiring strong, steerable directional signals, or in applications requiring the ability to minimize the effects of interference either from other sources or interference to other communication systems.

7. The Cancellation Current Barrier (FIGS. 21 through 24)

During normal operation of the surface deployed current driver as illustrated in FIG. 8, induced ground currents are typically produced near the center of the current driver. These induced ground currents, referred to hereinafter as "cancellation currents," act to effectively short out the current driver, and their effect is especially apparent at high frequencies such as those in excess of 20 MHz because of the low per unit length capacitive reactance of the current driver at these frequencies. As a result, it would be a further improvement in the communication system to provide a means for removing these unwanted cancellation currents.

One preferred embodiment of a means for overcoming the cancellation current problem described above is illustrated in FIG. 21. In this embodiment, a layer of porous low conductivity material 140 is positioned directly beneath the center portion of current driver 50, so as to prevent or greatly reduce the formation of induced ground currents near the center of the current driver. One type of low conductivity material which has been found well suited for this use is gravel or small to medium size rocks. Optionally, connected to the lower portion of the porous material 140 is a drain 142. The drain 142 is provided so as to preclude collection of water in the areas containing material 140, thus preventing formation of higher conductivity paths through such water.

Another preferred embodiment of an arrangement for overcoming the cancellation current problem is illustrated in FIG. 22. In this embodiment, balun 17 is positioned on or near the surface of the earth 11, with the inner portions of insulated conducting arms 16 and 18 being supported above the surface of the earth 11 by means of nonconducting posts or stakes 70. Stakes 70 are secured in the earth 11 so as to extend approximately one to two feet above the surface thereof. Connecting devices such as pins or clamps (not shown) are affixed to the top surface of stakes 70 so as to secure conducting arms 16 and 18 in position above the earth's surface 11.

In the configuration of FIG. 212, the outer portions of conducting arms 16 and 18 are positioned upon the surface of the earth 11. Since capacitive coupling between current driver 50 and earth 11 only occurs along those portions of conducting arms 16 and 18 which are positioned upon the earth itself, the ground currents induced into the earth form current loops 15 which extend only between the outer portions of conducting arms 16 and 18. As a result, cancellation currents which are normally induced in the earth near the central portion of current driver 50 are eliminated, and a more clearly defined vertical plane polarized antenna is formed by the current loops 15 and current driver 50. Thus, capacitive coupling may be encouraged to occur in preferential coupled regions.

FIGS. 23 and 24 illustrate another preferred embodiment for eliminating cancellation currents which are produced by the unidirectional antenna configuration. In the embodiment of FIG. 23, the length of that portion of conducting arm 226 positioned upon the surface of the earth 11 is approximately equal to the length of conducting arm 228 which is also positioned upon the earth. However, the portion of conducting arm 226 supported above the earth is significantly less than the corresponding supported portion of arm 228. In this manner, the loop current path 208 is caused to substantially avoid the area close to balun 17.

By reference to FIG. 24 it is seen that while conducting arm 228 continues to be configured as in FIG. 23, conducting arm 226 is configured such that its entire remaining length is positioned upon the surface of earth 11. The performance of this system has been found to be very similar to that of the configuration of FIG. 23.

By suspending the front portion of the unidirectional antenna above the surface of the ground, an additional gain of up to 10 dB beyond that experienced by the surface deployed undirectional current driver is produced. In fact, with poor earth (low conductivity) the gain of the single element current driver configurations of either FIG. 23 or FIG. 24 has been found to be approximately +4 dB isotropic in the 10 to 20 MHz frequency range. A four element system had a gain of about 10 dB in this frequency range. The length of this antenna was 150 feet. Thus, it is seen that though use of the above-described cancellation current barriers, capacitive coupling may be encouraged to occur in preferential coupled regions, and communication system efficiency is further improved.

Because of its small size and corresponding minimal wind resistance, the tape current driver 50 is particularly suited for the aboveground configuration illustrated in FIGS. 22 through 24. Nevertheless, this configuration may also be utilized by other current driver constructions, including the belt configuration to be described more fully hereinafter.

8. The Belt Current Driver (FIG. 25)

Another preferred embodiment of the present invention comprises a belt current driver as illustrated in FIG. 25. The belt current driver generally indicated at 300 in FIG. 25 includes a transmission line balun 17 that provides impedance matching as well as balance-to-unbalance transformer action in the manner described previously. Secured to balun 17 and extending outward therefrom is a coax cable connector 302 which provides for interconnection of a coaxial cable through which the system is controlled. Connected to balun 17 and extending outwardly in end-to-end relationship are first and second conducting arms 304 and 306 respectively. Conducting arms 304 and 306 comprise electrically conductive wires, cables, or similar conductors which are sufficiently flexible to be stored in a rolled up or coiled position. Substantially the entire external surface of conducting arms 304 and 306 may be protected by a sheath of electrical insulating material so as to prevent direct electrical conduct with the surrounding surfaces.

The above-described current driver elements are secured by well-known conventional securing means within a nonconducting, flexible belt or sheath of fabric 308. Typical materials which may be utilized in constructing belt 308 include cloth, carpet, canvasing, belting, webbing, fiber, resin sandwiches made into negator springs, and deposited plastics, to name a few. The current driver 300 is configured such that it may be stored in a rolled up position, and so that it may be quickly deployed by simply unrolling it upon the surface of the earth.

Since the conducting arms 304 and 306 of belt current driver 300 are secured within fabric 308, it is possible to increase the capacitive coupling between current driver 300 and the earth by merely providing constructing conducting arms 304 and 306 of a plurality of conductive wires arranged in parallel configuration within the fabric 308. In addition, as illustrated in FIG. 25, a switching arrangement may also be secured within fabric 308 such that current driver 300 may include the capability of being a completely self-contained, switchable system for functioning in different frequency ranges and/or as a unidirectional or bidirectional current driver.

Specifically, in its switchable configuration, conducting arms 304 and 306 of current driver 300 are interconnected by a series of switching devices 310 and 312. Each switching device 310 and 312 may be, for example, a conventional electrical relay which can be activated remotely from a control center (not shown) to connect or disconnect the various lengths of the conducting arms 304 and 306. Although only two switching elements are illustrated in FIG. 25, it becomes readily apparent that any numberof such elements may be included so as to provide for as many different operating lengths of conducting arms 304 and 306 as is desired.

The switching elements 310 and 312 may also comprise conventional pneumatic switches, relays or other suitable types of conventional switching devices. When using electrical relays as switches, it is necessary to use RF chokes 314 connected to the devices as by lines 316 and 318 and located within the belt fabric 308. Control lines 319 are connected from the remote control unit (not shown) through the chokes to lines 316. Pneumatic switches with dielectric control lines avoid the use of RF chokes, and thus provide increased electromagnetic pulse (EMP) hardness, but they also require additional control lines to be extended to and connected with the current driver 300.

In addition to the configuration illustrated in FIG. 25, current driver 300 may also include tree terminations (not shown) connected to the ends of conducting arms 304 and 306 in the manner previously described. Thus, it becomes apparent that the belt current driver 300 may be utilized in substantially any of the applications described herein with respect to the other preferred embodiments of the invention. Because of its increased mass over the tape embodiment, current driver 300 is less susceptible to the effects of winds when it is placed upon the surface of the earth. Conversely, it is somewhat more difficult to support the belt embodiment in the partially elevated configurations of FIGS. 22 through 24 than it is to support the tape embodiment of those configurations. In all other respects, the operating characteristics of the current driver 300 are substantially identical to the other embodiments of the bidirectional and unidirectional low profile current drivers described herein.

In each of the embodiments disclosed herein, the current drivers and their related elements may be painted so as to appear camouflaged when deployed. In addition, these systems can be further camouflaged by covering those portions of the current driver which are positioned upon the surface of the earth by a layer of earth, sand, leaves or other substances which have an equal or lower conductivity than the earth upon which the current driver is positioned. Such camouflage materials can be placed over the antenna at a depth of up to about one foot without appreciable degradation of system efficiency and performance. Thus, the current driver embodiments disclosed herein are particularly useful in defense oriented applications, and in any other applications wherein concealment of such a wireless communication system is desirable.

9. Design Considerations

The foregoing embodiments illustrate many of the wide variety of ways in which the principles of the present invention can be practiced. Following is a brief summary of the principal design criteria for determining required current driver length. This criteria may be varied to meet the design considerations imposed by a given system.

Current driver length is inversely proportional to the system's signal frequency. As described above, depending upon whether tree terminations are utilized on the current driver ends, minimum total current driver length will range from three-quarters to one signal wavelength as measured in the ground medium at the desired frequency. Signal wavelength in a ground medium is graphically illustrated as a function of signal frequency in FIG. 26. Graph line 34 represents the wavelength in meters as a function of frequency in rich agricultural earth having a conductivity of $10^{-2}$ mho per meter. Graph line 36 indicates the wavelength in meters as a function of frequency in rocky land having a conductivity of $2\times10^{-3}$ mho per meter. The area 38 between lines 34 and 36 describes the signal wavelength as a function of signal frequency in the majority of typical kinds of ground media. The equation for determining the wavelength represented by lines 34 and 36 of FIG. 26 is $$\lambda = \frac{\kappa}{f\sqrt{\frac{\mu\epsilon}{2}\left(\sqrt{1+\left(\frac{\sigma}{\omega\epsilon}\right)^2}+1\right)}} \qquad (1)$$

where $\lambda$=wavelength in the earth (meters)

$\kappa$=1 for large depth and $\sqrt{2}$ for current driver at or above the surface $\mu$=permeability of the earth ($4\pi\times10^{-7}$ weber/amp-meter)

$\epsilon=\epsilon_0\epsilon_r$=permittivity of earth (farad/meter)

$\epsilon_0$=permittivity of free space ($8.85\times10^{-12}$ farad/meter)

$\epsilon_r$=relative permittivity of earth (farad/meter)

$\sigma$=conductivity of earth (mho/meter)

$\omega=2\pi f$ f=frequency (Hz).

In the case of a communication system operating at a frequency of 400 KHz, from equation (1) the signal wavelength is equal to approximately 100 meters when propagated through low conductivity ground at that frequency. Thus, total current driver length will range from 75 to 100 meters, depending on whether tree terminations are used at the ends of the current driver.

FIG. 27 graphically illustrates the penetration or skin depth as a function of signal frequency. This information is necessary in determining desired spacing between current drivers in current driver arrays. As previously indicated, parallel spacing of current drivers in arrays can be as close as approximately half a skin depth. Graph line 48 represents the penetration depth in meters as a function of frequency in rich agricultural earth having a conductivity of $10^{-2}$ mho per meter. Graph line 49 indicates the penetration depth in rocky land having a conductivity of $2\times10^{-3}$ mho per meter. The area 47 between lines 48 and 49 describes the penetration depth in the majority of typical kinds of ground media. The equation for determining the penetration depth represented by lines 48 and 49 of FIG. 16 is $$\delta = \frac{1}{\omega\sqrt{\frac{\mu\epsilon}{2}\left(\sqrt{1+\frac{\sigma^2}{\omega^2\epsilon^2}}-1\right)}} \qquad (2)$$

where $\delta$=is the penetration depth (meters)

$\omega=2\pi f$ $\mu$=the relative permeability of the surrounding earth (weber/amp-meter)

$\sigma$=the conductivity of the surrounding earth (mho/meter)

$\epsilon$=the dielectric constant of the surrounding earth.

It is well-known that for low frequencies in the range of 50 to 150 KHz, equation (2) may be simplified to $$\delta = \frac{1}{\sqrt{\pi f \mu \sigma}} = \frac{503.3}{\sqrt{f\sigma}} \quad (3)$$

Thus, using as an example a system operating at 150 KHz, and assuming the conductivity of the surrounding earth to be $10^{-3}$ mho per meter, from equation (3) the penetration depth would be about 41 meters, and parallel current driver spacing in this situation should be no less than about 20.5 meters.

9. Summary (U)

The current driver configurations embodied in the present invention offer the following advantages, among others: (1) the low profile positioning of the current driver provides greatly increased system hardness over typical aboveground antenna systems, while permitting data transmission on a wide frequency band and, when using enhanced signal processing, at data rates comparable to conventional aboveground systems; (2) because of its low profile positioning and the use of capacitive coupling with the earth to produce a vertical plane polarized antenna configuration, the communication system of the present invention permits practical communication at frequencies ranging from the VLF range to the VHF range; (3) by placing two or more low profile current drivers in a parallel array configuraton, signal power gain and communication system operating efficiency equal to or better than that of conventional aboveground monopole antennas may be achieved, while requiring only a relatively small ground area for the placement of the current driver array; (4) by use of the tree terminations, coupling is improved and the mean location of capacitive coupling between the current driver and the earth is extended toward the outer ends of conducting arms, with the result that the required current driver length for operation at a given frequency is significantly reduced; (5) because of increased bandwidth and directional steering the system has potential for very low vulnerability to jamming and other adverse effects of interfering electromagnetic radiation; (6) by configuring the current driver such that one end is shorter than the other, a unidirectional vertical plane polarized antenna can easily and quickly be formed, having improved signal gain and narrowed beam width for further improvement in the ability to avoid signal interference; (7) a means is provided whereby the undesirable effects of induced ground currents near the center of the current driver can be eliminated; (8) the communication system described herein is also adaptable for use in quick deployment mode, or in a shallow trench so as to further increase system hardness; (9) camouflage of the system is a simple matter, and decoying through use of dummy current drivers is also economically feasible; (10) because of its small size and light weight, the communication system may be easily transported on foot, and may be rapidly deployed and retrieved during operation in the field; (11) environmental impacts are minimized and surrounding aesthetic conditions are preserved; and (12) overall costs are significantly reduced, permitting redundancy of installation to further increase system hardness.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A wireless low profile communication system including a transmitter/receiver for generating and processing electromagnetic signals, the system comprising:

a portable current driver comprising conductor means and means for selectively translating said conductor means between a transportable configuration and an operational configuration, such that when in said operational configuration said conductor means is positioned in proximity to the earth's surface, said conductor means comprising means for capacitively coupling said conductor means to the earth along at least a portion of said conductor means so that said conductor means exhibits substantial capacitive coupling to the earth such that a closed current loop is formed by said conductor means in combination with the earth, said conductor means having a sufficient overall length so that the closed current loop has a perimeter which is greater than one wavelength of said electromagnetic signals when propagating through the earth, whereby the earth and said conductor means function together as a vertical plane polarized antenna; and means for connecting the transmitter/receiver to the conductor means.

2. A wireless communication system as defined in claim 1 wherein the current driver means is protected along substantially its entire length by an external sheath of electrical insulating material.

3. A system as defined in claim 1 further comprising means for inhibiting electrical coupling along portions of the length of the conductor means so as to eliminate cancellation currents.

4. A system as defined in claim 1 wherein the conductor means of the current driver comprises at least two conductive tapes which are protected along substantially their entire length by an external sheath of electrical insulating material.

5. A system a defined in claim 1 wherein the conductor means of the current driver comprises at least two lightweight, flexible conductors secured within a flexible sheath of fabric so as to be rapidly deployable, and retrievable into a compact coiled configuration.

6. A system as defined in claim 1 wherein the length of one of the conductor means is less than the length of the other of said conductor means such that the electromagnetic signal transmitted outwardly in the direction of said other conductor means has a greater signal gain than the electromagnetic signal transmitted outwardly in the direction of said one conductor means.

7. A system as defined in claim 1 further comprising means for carrying the current driver when said current driver is in the transportable configuration.

8. A system as defined in claim 1 wherein the conductor means is further selectively translated between a first operational configuration and at least one additional operational configuration.

9. A low profile wireless communication system including a transmitter/receiver for generating and processing electromagnetic signals, the system comprising:

a transportable current driver capable of rapid development and providing for quick retrieval and retention in a compact configuration, said current driver comprising a first conductor, a second conductor and means for selectively translating said conductors between a transportable configuration and an operational configuration such that when said conductors are deployed in an operational configuration said conductors are in proximity to the earth's surface, said conductors each comprising means for encouraging substantial capacitive coupling between at least a portion of said conductors and the earth in a preferential coupled region so as to establish a closed current loop in the earth by said conductors in combination with the earth, said conductors having a sufficient overall length so that said closed current loop has a perimeter which is greater than one wavelength of said electromagnetic signals when propagating through the earth, whereby the earth and said conductors function together as a vertical plane polarized antenna;

means for connecting the transmitter/receiver to the current driver;

means connected to the first and second conductors for adjusting the impedance presented to the transmitter/receiver by the current driver so as to correlate said impedance with the impedance of the transmitter/receiver; and means for connecting the adjusting means to the transmitter/receiver.

10. A system as defined in claim 9 wherein the first and second conductors are positioned in end-to-end configuration and wherein the means for adjusting impedance values is positioned between the adjacent ends of said first and second conductors.

11. A system as defined in claim 10 wherein the length of one of the conductors is less than the length of the other conductor such that the electromagnetic signal transmitted outwardly in the direction of said other conductor has a greater signal gain than the electromagnetic signal transmitted outwardly in the direction of said one conductor.

12. A system as defined in claim 9 wherein the adjusting means comprises a balun.

13. A system as defined in claim 9 wherein the current driver is protected along substantially its entire length by an external sheath of electrical insulating material.

14. A system as defined in claim 9 further comprising means for inhibiting electrical coupling along portions of the length of the conductor means so as to eliminate cancellation currents.

15. A system as defined in claim 14 wherein the means for inhibiting cancellation currents comprises low conductivity materials positioned so as to lie at least partially in flow paths of said cancellation currents and to inhibit the flow of said cancellation currents therethrough.

16. A system as defined in claim 9 wherein the current driver further comprises conductive tree terminations attached to the end of at least one of the conductors so as to provide for system operation at lower frequencies, said tree terminations being protected about substantially their entire outer surface by an external sheath of electrical insulating material.

17. A system as defined in claim 9 wherein each of the conductors are divided into plural lengths and wherein the current driver further comprises switching means selectively connecting the various lengths of each conductor such that the overall length of each conductor can be varied for purposes of system operation at various frequencies and for purposes of controlling signal gain, propagation direction and waveshape corresponding to the different possible current driver lengths.

18. A system as defined in claim 9 further comprising a plurality of current drivers which are spaced in parallel to form a current driver array, said parallel spacing between current drivers being no less than about half a skin depth in the earth at the system operating frequency.

19. A system as defined in claim 18 further comprising: a power splitter interconnected between said transmitter/receiver and each current driver in the array, the power splitter being connected to each of said current drivers in the array through substantially equal lengths of coaxial cable, and said power splitter providing power of the same amplitude and phase to each of said current drivers.

20. A system as defined in claim 18 wherein at least one of the conductors in at least one of the current drivers in the array is divided into a plurality of lengths, with switching means selectively connected to the various lengths of each said divided conductor in order to vary the overall length of each divided conductor so as to provide for system operation at any one of a plurality of different frequency ranges, and for purposes of controlling signal gain, propagation direction and waveshape corresponding to the different possible current driver lengths.

21. A system as defined in claim 18 wherein the overall width of the current driver array is no greater than half a signal wavelength in air at the system's operating frequency in order to experience substantially no beam depression.

22. A system as defined in claim 18 wherein one or more of the said current drivers comprise conductive tree terminations attached to the ends thereof.

23. A system as defined in claim 9 wherein the current driver is supported above, but in proximity to, the earth's surface along the inward portion of the length of at least one of the conductors, with at least the outward portion of said conductors being coupled to the earth's surface such that the electrical current induced into the earth defines a closed current loop whose ends extend to the outward portion of at least one of said conductors, inhibiting cancellation currents near the central portion of said current driver.

24. A system as defined in claim 9 wherein the conductors of the current driver comprise retractable conductive tapes which are protected along substantially their entire length by an external sheath of electrical insulating material.

25. A system a defined in claim 9 wherein each of the conductors of the current driver comprise at least one lightweight, flexible lengths of conductive materials secured within a sheath of flexible fabric so as to be rapidly deployable, and retrievable into a compact coiled configuration.

26. A system as defined in claim 9 further comprising means for carrying the current driver when said current driver is in the transportable configuration.

27. A system as defined in claim 9 wherein the conductor means is further selectively translated between a first operational configuration and at least one additional operational configuration.

28. A wireless low profile communication system including a transmitter/receiver for generating and processing electromagnetic signals, the system comprising:

first and second conductors retained within a deployment medium, said conductors and said deployment medium being rapidly translatable between a transportable configuration and an operational configuration wherein said conductors are positioned end-to-end and in substantially axial alignment in proximity to the surface of the earth along at least a portion of their length, said conductors comprising means for encouraging capacitive coupling between said conductors and the earth so that said conductors and the earth in combination establish a closed current loop, said conductors being extendable to a sufficient overall length so that the closed current loop has a perimeter which is greater than one wavelength of the signal frequency in earth, whereby the earth and the current driver function together as a vertical plane polarized antenna; and means for connecting the transmitter/receiver to said conductors.

29. A system as defined in claim 28 further comprising means for inhibiting capacitive coupling along portions of the length of said conductors so as to eliminate cancellation currents.

30. A system as defined in claim 29 wherein the inhibiting means comprises support means upon which the current driver is positioned so as to be supported above, but in proximity to, the earth's surface along the inward portion of the length of at least one of the conductors, with at least the outward portion of said conductors being coupled to the earth's surface so that the electrical current induced into the earth defines closed current loop paths which extend to the outward portion of at least one of said conductors, substantially eliminating cancellation currents near the central portion of said current driver.

31. A system as defined in claim 28 wherein said conductors are protected along substantially their entire length by an external sheath of electrical insulating material.

32. A system as defined in claim 28 wherein the conducting arms comprise conductive metallic tapes.

33. A system as defined in claim 28 wherein the conductors and said deployment medium are positioned in a coiled arrangement when in the transportable configuration.

34. A system as defined in claim 28 further comprising means connected to the first and second conductors for adjusting impedance values of the current driver which may exist beyond one wavelength at the operating frequency so as to correlate said impedance with the impedance of the transmitter/receiver.

35. A system as defined in claim 28 wherein the relative length of the conductors may be varied such that the length of one conductor is less than the length of the other conductor, whereby those electromagnetic signals transmitted from the system in the direction of said other conductor have a greater signal gain than those electromagnetic signals transmitted outwardly in the direction of said one conductor.

36. A system as defined in claim 28 wherein the conductors are each capacitively coupled to the earth in a preferential coupled region.

37. A system as defined in claim 28 further comprising means for carrying the current driver when said current driver is in the transportable configuration.

38. A system as defined in claim 28 wherein the conductor means is further selectively translated between a first operational configuration and at least one additional operational configuration.

39. A system as defined in claim 28 wherein the conductors are divided into plural lengths and wherein switching means are secured within the deployment medium so as to selectively connect the various lengths of each conductor such that the overall length of each conductor can be varied for purposes of system operation at various frequencies and for purposes of controlling signal gain, propagation direction and waveshape corresponding to the different possible conductor lengths.

40. A system as defined in claim 28 wherein each of the conductors of the current driver are comprised of plural parallel lengths of conductive material.

41. A system as defined in claim 28 wherein conductive tree terminations are secured within the deployment medium and are attached to the ends of said conductors.

42. A wireless low profile communication system including a transmitter/receiver for generating and processing electromagnetic signals, the system comprising:

a transportable housing and a transportable current driver, said current driver comprising first and second lightweight flexible conductors, said housing comprising means from which said conductors are rapidly translated between a compact coiled configuration within said housing and at least one operational configuration wherein said conductors are positioned end-to-end and in substantially axial alignment, said conductors comprising an electrical insulating material along at least a portion of their length, said insulating material encouraging capacitive coupling between said conductors and the earth when the conductors are deployed substantially parallel to, and in close proximity to, the surface of the earth along at least a portion of their length so that said conductors will be coupled to the earth in a preferential coupled region such that a closed current loop is established in the earth by the combination of said conductors and the earth, said conductors being extendable to a sufficient overall length so that said closed current loop has a perimeter which is greater than one wavelength of said electromagnetic signals when propagating through the earth, whereby the earth and said current driver function as a vertical plane polarized antenna;

a balun connected to the current drive for adjusting the impedance presented to the transmitter/-receiver by said current driver so as to correlate said impedance with the impedance of the transmitter/receiver; and a coaxial cable interconnecting the balun to the transmitter/receiver.

43. A system as defined in claim 42 further comprising means for inhibiting electrical coupling along portions of the length of the conductor means so as to eliminate cancellation currents.

44. A system as defined in claim 43 wherein the inhibiting means comprises support means upon which the current driver is positioned so as to be supported above, but in proximity to, the earth's surface along the inward portion of the length of at least one of the conductors, with at least the outward portion of said conductors being coupled to the earth's surface so that the electrical current induced into the earth defines closed current loop paths which extend to the outward portion of at least one of said conductors, substantially eliminating cancellation currents near the central portion of said current driver.

45. A system as defined in claim 42 wherein the housing includes a retaining means upon which the conducting arms are wound in coiled configuration when retracted, and wherein the retracted current driver is compactly secured within the housing for storage and transport.

46. A system as defined in claim 42 wherein the relative length of the conductors may be varied such that the length of one conductor is less than the length of the other conductor, whereby those electromagnetic signals transmitted from the system in the direction of said other conductor have a greater signal gain than those electromagnetic signals transmitted outwardly in the direction of said one conducting arm.

47. A system as defined in claim 42 wherein the conductors of the current driver comprise retractable conductive tapes which are protected along substantially their entire length by an external sheath of electrical insulating material.

48. A system as defined in claim 42 further comprising means for carrying the current driver when said current driver is in a transportable configuration.

49. A system as defined in claim 42 wherein the conductors are divided into plural lengths and said system further comprises switching means to selectively connect the various lengths of each conductor such that the overall length of each conductor can be varied for purposes of system operation at various frequencies and for purposes of controlling signal gain, propagation direction and waveshape corresponding to the different possible current driver lengths.

50. A system as defined in claim 42 wherein each of the conductors of the current driver are comprised of plural parallel lengths of conductive material.

51. A system as defined in claim 42 wherein said system further comprises conductive tree terminations which are attached to the ends of said conductors.

52. A method of sending and receiving electromagnetic signals using a low profile wireless communication system comprising a transmitter/receiver for generating and processing electromagnetic signals and a transportable current driver means connected to said transmitter/receiver and being capable of rapid deployment and retrieval, comprising at least two conductors connected to said transmitter/receiver, wherein the method comprises the steps of:

selectively rolling said conductors out to deploy said conductors in one of a plurality of operational configurations such that when in said operational configurations, said conductors are positioned so as to each lie in close proximity to the surface of the earth along at least a portion of their length;

capacitively coupling said current driver means to the earth so that said current driver means and earth together provide a closed current loop having a perimeter which is greater than one wavelength of the electromagnetic signals when propagating through the earth, whereby said current drive means and the earth function as a vertical plane polarized antenna.

53. A method as defined in claim 52 wherein the communication system includes a plurality of current drivers and wherein the method further comprises the step of placing the current drivers parallel one to the other and as close as half a skin depth between adjacent current drivers, thus forming an array of current drivers.

54. A method as defined in claim 52 further comprising the step of providing each current driver of said array with power that is substantially equal in phase and magnitude.

55. A method as defined in claim 52 further comprising the step of steering the signals produced by the vertical plane polarized antennas.

56. A method as defined in claim 52 further comprising the steps of:

dividing at least one conductor of the current driver into a plurality of lengths; and selectively interconnecting the various lengths to provide the current driver with the capability of being used at various frequencies and of producing various signal types and waveshapes depending upon the number of lengths connected together.

57. A method as defined in claim 52 further comprising the step of configuring the current driver such that the length of one of its extended conductors is less than the length of its other extended conductor, whereby the electromagnetic signal transmitted outwardly in the direction of said other conductor has a greater gain than the electromagnetic signal transmitted outwardly in the direction of said one conductor.

58. A method as defined in claim 52 further comprising the step of applying a sheath of electrical insulating material along substantially the entire exterior portion of each of the conductors.

59. A method as defined in claim 52 further comprising the step of orienting the current driver means so as to be substantially parallel with the surface of the earth.

60. A method as defined in claim 52 further comprising the step of inhibiting said capacitive coupling along portions of the length of the conductors so as to eliminate cancellation currents.

61. A method as defined in claim 52 wherein the inhibiting step additionally comprises the step of supporting the inward portion of the length of at least one of the conductors above, but in proximity to, the earth's surface, with at least the outward portion of the length of said conducting arms being capacitively coupled to the earth's surface.

62. A method as defined in claim 52 wherein the inducing step comprises capacitively coupling the conductors to the earth in a preferential coupled region.

63. A method as defined in claim 52 further comprising the step of translating the conductors between a first operational configuration and at least one other operational configuration.

64. A method as defined in claim 52 further comprising the step of adjusting the impedance of the current driver means and the earth so that said impedance will correlate to the impedance of the transmitter/receiver at impedances corresponding to operation beyond one wavelength at the signal frequency.

65. A method of sending and receiving electromagnetic signal using a low profile wireless communication system comprising a transmitter/receiver for generating and processing electromagnetic signals and a transportable current driver means connected to said transmitter/receiver being capable of rapid deployment and retrieval, comprising at least two conductors connected to said transmitter/receiver, wherein the method comprises the steps of:

positioning the current driver so as to be in proximity to the earth's surface;

translating the conductors between a transportable configuration and an operational configuration such that when in said operational configuration, said conductors are positioned so as to each lie in close proximity to the surface of the earth along to least a portion of their length;

capacitively coupling each of the conductors to the earth in a preferential coupled region of the conductor's length so as to provide a closed current loop;

interconnecting an adjusting means to the first and second conductors and through a first coaxial cable to the transmitter/receiver;

adjusting the impedance presented to the transmitter/receiver by the first and second conductors so that said impedance will correlate to the impedance of the transmitter/receiver for system operation beyond one wavelength at the signal frequency; and selecting the length of the conductors to establish a closed current loop having a perimeter which is greater than one wavelength of the electromagnetic signals when propagating through the earth, whereby said current driver means and the earth function as a vertical plane polarized antenna.

66. A method as defined in claim 65 further comprising the step of inhibiting said capacitive coupling along portions of the length of the conductors so as to diminish cancellation currents.

67. A method as defined in claim 66 wherein the inhibiting step comprises positioning low conductivity material in proximity to the current driver so as to substantially eliminate cancellation currents near the center portion of said current driver.

68. A method as defined in claim 66 wherein the inhibiting step additionally comprises the step of supporting the inward portion of the length of at least one of the conductors above, but in proximity to, the earth's surface, with at least the outward portion of the length of said conducting arms being capacitively coupled to the earth's surface.

69. A method as defined in claim 65 further comprising the steps of:

dividing at least one conductor of the current driver into a plurality of lengths; and selectively interconnecting one or more of the various lengths to provide the current driver with the capability of being used at various frequencies and of producing various signal types and waveshapes depending upon the number of lengths connected together.

70. A method as defined in claim 65 further comprising the step of configuring the current driver such that the length of one of its extended conductors is less than the length of its other extended conductor, whereby the electromagnetic signal transmitted outwardly in the direction of said other conductor has a greater gain than the electromagnetic signal transmitted outwardly in the direction of said one conductor.

71. A method as defined in claim 65 further comprising the step of:

winding the conductors into a coiled configuration about a retaining means so as to maintain the conductors in a retracted state; and securing the retracted conductors and the adjusting means within a current driver housing for storage and transport.

72. A method as defined in claim 65 further comprising the steps of securing the conductors within flexible fabric.

73. A method as defined in claim 72 further comprising the steps of:

dividing the conductors into more than one length;

securing switching means within the flexible fabric; and selectively connecting the various lengths of the conductors by use of the switching means such that the overall length of each conductor can be varied for purposes of system operation at various frequencies and for purposes of controlling signal gain, propagation direction and waveshape corresponding to the different possible current driver lengths.

74. A method as defined in claim 72 further comprising the steps of:

securing conductive tree terminations within the flexible fabric; and attaching the tree terminations to the ends of conductors so as to provide for system operation at lower frequencies.

75. A method as defined in claim 65 further comprising the step of translating the conductors between a first operational configuration and at least one other operational configuration.

76. A method as defined in claim 65 wherein the inducing step comprises capacitively coupling the conductors to the earth in a preferential coupled region of the conductor's length.

* * * * *

UNITED STATES PATENT AND TRADEMARK OFFICE

CERTIFICATE OF CORRECTION

PATENT NO. : 4,809,010

DATED : February 28, 1989

INVENTOR(S) : Theodore M. Blum

It is certified that error appears in the above-identified patent and that said Letters Patent is hereby corrected as shown below:

Column 1, line 23, "Aboveground wireless communication" should be --Above-ground wireless communication--

Column 4, line 54, "impedence" should be --impedance--

Column 7, line 21, "FIG. 5" should be --FIG. 15--

Column 8, line 68, after "normal to" add --the central axis of the dipole antenna.--

Column 10, line 5, "convnetional" should be --conventional--

Column 17, lines 27-28, "conductor 85-88." should be --conductors 85-88.--

Column 17, line 39, "he conducting arm 82," should be --the conducting arm 82,--

Column 17, line 40, "conductor 85-88." should be --conductors 85-88.--

Column 17, line 41, "conductor 85-88." should be --conductors 85-88.--

Column 18, lines 51-52, "he transmitter/receiver," should be --the transmitter/receiver,--

Column 22, line 63, "numberof" should be --number of--

Column 28, line 52, "a defined" should be --as defined--

Column 28, line 54, "flexible lengths of conductive materials" should be --flexible length of conductive materials--

Column 32, line 61, "signal" should be --signals--

UNITED STATES PATENT AND TRADEMARK OFFICE

CERTIFICATE OF CORRECTION

PATENT NO. : 4,809,010

DATED : February 28, 1989

INVENTOR(S) : Theodore M. Blum

It is certified that error appears in the above-identified patent and that said Letters Patent is hereby corrected as shown below:

Column 33, lines 7-8, "to least" should be --at least--.

Signed and Sealed this

Sixth Day of March, 1990

*Attest:*

*Attesting Officer*

JEFFREY M. SAMUELS

*Acting Commissioner of Patents and Trademarks*

UNITED STATES PATENT AND TRADEMARK OFFICE

CERTIFICATE OF CORRECTION

PATENT NO. : 4,809,010

DATED : February 28, 1989

INVENTOR(S) : Ferril A. Losee

It is certified that error appears in the above-identified patent and that said Letters Patent is hereby corrected as shown below:

Title page, column 1, lines 4-5, "Assignee: Canon Kabushiki Kaisha, Tokyo, Japan" should be --Eyring Research Institute, Inc., Provo, Utah--

Title page, column 2, lines 13-14, "Attorney, Agent, or Firm - Fitzpatrick, Cella, Harper & Scinto" should be --Attorney, Agent, or Firm - Workman, Nydegger & Jensen--

Column 1, line 23, "Aboveground wireless communication" should be --Above-ground wireless communication--

Column 4, line 54, "impedence" should be --impedance--

Column 7, line 21, "FIG. 5" should be --FIG. 15--

Column 8, line 68, after "normal to" add --the central axis of the dipole antenna.--

Column 10, line 5, "convnetional" should be --conventional--

Column 17, lines 27-28, "conductor 85-88." should be --conductors 85-88.--

Column 17, line 39, "he conducting arm 82," should be --the conducting arm 82,--

Column 17, line 40, "conductor 85-88." should be --conductors 85-88.--

Column 17, line 41, "conductor 85-88." should be --conductors 85-88.--

UNITED STATES PATENT AND TRADEMARK OFFICE

CERTIFICATE OF CORRECTION

PATENT NO. : 4,809,010

DATED : February 28, 1989

INVENTOR(S) : Ferril A. Losee

It is certified that error appears in the above-identified patent and that said Letters Patent is hereby corrected as shown below:

Column 18, lines 51-52, "he transmitter/receiver," should be --the transmitter/receiver,--
Column 22, line 63, "numberof" should be --number of--
Column 28, line 52, "a defined" should be --as defined--
Column 28, line 54, "flexible lengths of conductive materials" should be --flexible length of conductive materials--
Column 32, line 61, "signal" should be --signals--
Column 33, lines 7-8, "to least" should be --at least--

This certificate supersedes certificate of correction issued March 6, 1990.

Signed and Sealed this

Eighteenth Day of June, 1991

*Attest:*

*Attesting Officer*

HARRY F. MANBECK, JR.

*Commissioner of Patents and Trademarks*